US010901332B2

(12) United States Patent
Fujita et al.

(10) Patent No.: US 10,901,332 B2
(45) Date of Patent: Jan. 26, 2021

(54) IMAGE FORMING APPARATUS AND IMAGE FORMING METHOD

(71) Applicant: KYOCERA Document Solutions Inc., Osaka (JP)

(72) Inventors: Toshiki Fujita, Osaka (JP); Nariaki Tanaka, Osaka (JP); Masahito Ishino, Osaka (JP); Kiyotaka Kobayashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/506,300

(22) Filed: Jul. 9, 2019

(65) Prior Publication Data

US 2020/0041917 A1 Feb. 6, 2020

(30) Foreign Application Priority Data

Jul. 31, 2018 (JP) ..... 2018-143067

(51) Int. Cl.
*G03G 5/00* (2006.01)
*G03G 5/047* (2006.01)
(Continued)

(52) U.S. Cl.
CPC ..... *G03G 5/047* (2013.01); *G03G 5/05* (2013.01); *G03G 5/056* (2013.01); *G03G 5/0592* (2013.01);
(Continued)

(58) Field of Classification Search
CPC .. G03G 5/047; G03G 21/0011; G03G 5/0609; G03G 5/0696; G03G 5/056;
(Continued)

(56) References Cited

U.S. PATENT DOCUMENTS 5,328,789 A * 7/1994 Nakamori ..... G03G 5/0609 430/58.25
8,846,281 B2 * 9/2014 Okuda ..... G03G 5/0564 399/159
(Continued)

FOREIGN PATENT DOCUMENTS

JP 2000-075752 A 3/2000

*Primary Examiner* — Mark A Chapman
(74) *Attorney, Agent, or Firm* — Studebaker & Brackett PC

(57) ABSTRACT

In an image forming apparatus, a cleaning member is pressed against a circumferential surface of an image bearing member and collects a toner remaining on the circumferential surface of the image bearing member. The toner has a number average roundness of 0.965 to 0.998. The toner has a $D_{50}$ of 4.0 μm to 7.0 μm. A linear pressure of the cleaning member on the circumferential surface of the image bearing member is 10 N/m to 40 N/m. The image bearing member includes a single-layer photosensitive layer containing a charge generating material and a hole transport material. Ionization potential $Ip_{HTM}$ of the hole transport material and ionization potential $Ip_{CGM}$ of the charge generating material satisfy mathematical formula (1) "$Ip_{HTM} \geq 5.30$ eV", mathematical formula (2) "$Ip_{CGM} \geq 5.30$ eV", and mathematical formula (3) "$0.09\ eV \leq |Ip_{HTM} - Ip_{CGM}| \leq 0.30\ eV$".

17 Claims, 6 Drawing Sheets

(51) Int. Cl.
*G03G 21/00* (2006.01)
*G03G 5/06* (2006.01)
*G03G 5/05* (2006.01)

(52) U.S. Cl.
CPC ..... *G03G 5/0596* (2013.01); *G03G 5/0607* (2013.01); *G03G 5/0609* (2013.01); *G03G 5/0614* (2013.01); *G03G 5/0672* (2013.01); *G03G 5/0696* (2013.01); *G03G 21/0011* (2013.01)

(58) Field of Classification Search
CPC .. G03G 5/0614; G03G 5/0607; G03G 5/0596; G03G 5/0592; G03G 5/05; G03G 5/0672
USPC ..... 430/119.86, 111.4
See application file for complete search history.

(56) References Cited

U.S. PATENT DOCUMENTS

| | | | | |
|---|---|---|---|---|
| 2017/0045834 | A1* | 2/2017 | Shirai | G03G 9/08724 |
| 2017/0068177 | A1* | 3/2017 | Shimizu | G03G 5/144 |
| 2017/0307989 | A1* | 10/2017 | Azuma | G03G 5/0696 |
| 2018/0046100 | A1* | 2/2018 | Maruo | G03G 5/0616 |

* cited by examiner

IMAGE FORMING APPARATUS AND IMAGE FORMING METHOD

INCORPORATION BY REFERENCE

The present application claims priority under 35 U.S.C. § 119 to Japanese Patent Application No. 2018-143067, filed on Jul. 31, 2018. The contents of this application are incorporated herein by reference in their entirety.

BACKGROUND

The present disclosure relates to an image forming apparatus and an image forming method.

An electrophotographic image forming apparatus collects toner remaining on a circumferential surface of an image bearing member therein using a cleaning member (for example, a cleaning blade). In order to form high-definition images, it is desirable to use a toner having a small particle diameter and a high roundness. However, such a toner easily passes through a gap between a cleaning member and a circumferential surface of an image bearing member, tending to cause insufficient cleaning. In order to prevent insufficient cleaning, for example, it has been contemplated to tightly press the cleaning member against the image bearing member. However, the cleaning member tightly pressed against the image bearing member rubs hard on the circumferential surface of the image bearing member, and as a result some failure may occur in the image bearing member.

In order to reduce friction force between the cleaning member and the circumferential surface of the image bearing member, for example, it has been contemplated to apply a lubricant to the image bearing member. For example, a known image forming apparatus includes a lubricant application mechanism located upstream of an image bearing member cleaning means.

SUMMARY

An image forming apparatus according to an aspect of the present disclosure includes an image bearing member and a cleaning member. The cleaning member is pressed against a circumferential surface of the image bearing member and collects a toner remaining on the circumferential surface of the image bearing member. The toner has a number average roundness of at least 0.965 and no greater than 0.998. The toner has a volume median diameter of at least 4.0 μm and no greater than 7.0 μm. A linear pressure of the cleaning member on the circumferential surface of the image bearing member is at least 10 N/m and no greater than 40 N/m. The image bearing member includes a conductive substrate and a single-layer photosensitive layer. The single-layer photosensitive layer contains a charge generating material, a hole transport material, an electron transport material, and a binder resin. Ionization potential $Ip_{HTM}$ of the hole transport material and ionization potential $Ip_{CGM}$ of the charge generating material satisfy mathematical formulae (1), (2), and (3).

$$Ip_{HTM} \geq 5.30 \text{ eV} \quad (1)$$

$$Ip_{CGM} \geq 5.30 \text{ eV} \quad (2)$$

$$0.09 \text{ eV} \leq |Ip_{HTM} - Ip_{CGM}| \leq 0.30 \text{ eV} \quad (3)$$

A method for forming an image according to another aspect of the present disclosure includes collecting a toner remaining on a circumferential surface of an image bearing member through a cleaning member being pressed against the circumferential surface of the image bearing member while the image bearing member is rotating. The toner has a number average roundness of at least 0.965 and no greater than 0.998. The toner has a volume median diameter of at least 4.0 μm and no greater than 7.0 μm. A linear pressure of the cleaning member on the circumferential surface of the image bearing member is at least 10 N/m and no greater than 40 N/m. The image bearing member includes a conductive substrate and a single-layer photosensitive layer. The single-layer photosensitive layer contains a charge generating material, a hole transport material, an electron transport material, and a binder resin. Ionization potential $Ip_{HTM}$ of the hole transport material and ionization potential $Ip_{CGM}$ of the charge generating material satisfy mathematical formulae (1), (2), and (3).

$$Ip_{HTM} \geq 5.30 \text{ eV} \quad (1)$$

$$Ip_{CGM} \geq 5.30 \text{ eV} \quad (2)$$

$$0.09 \text{ eV} \leq |Ip_{HTM} - Ip_{CGM}| \leq 0.30 \text{ eV} \quad (3)$$

DETAILED DESCRIPTION

Figure 1:
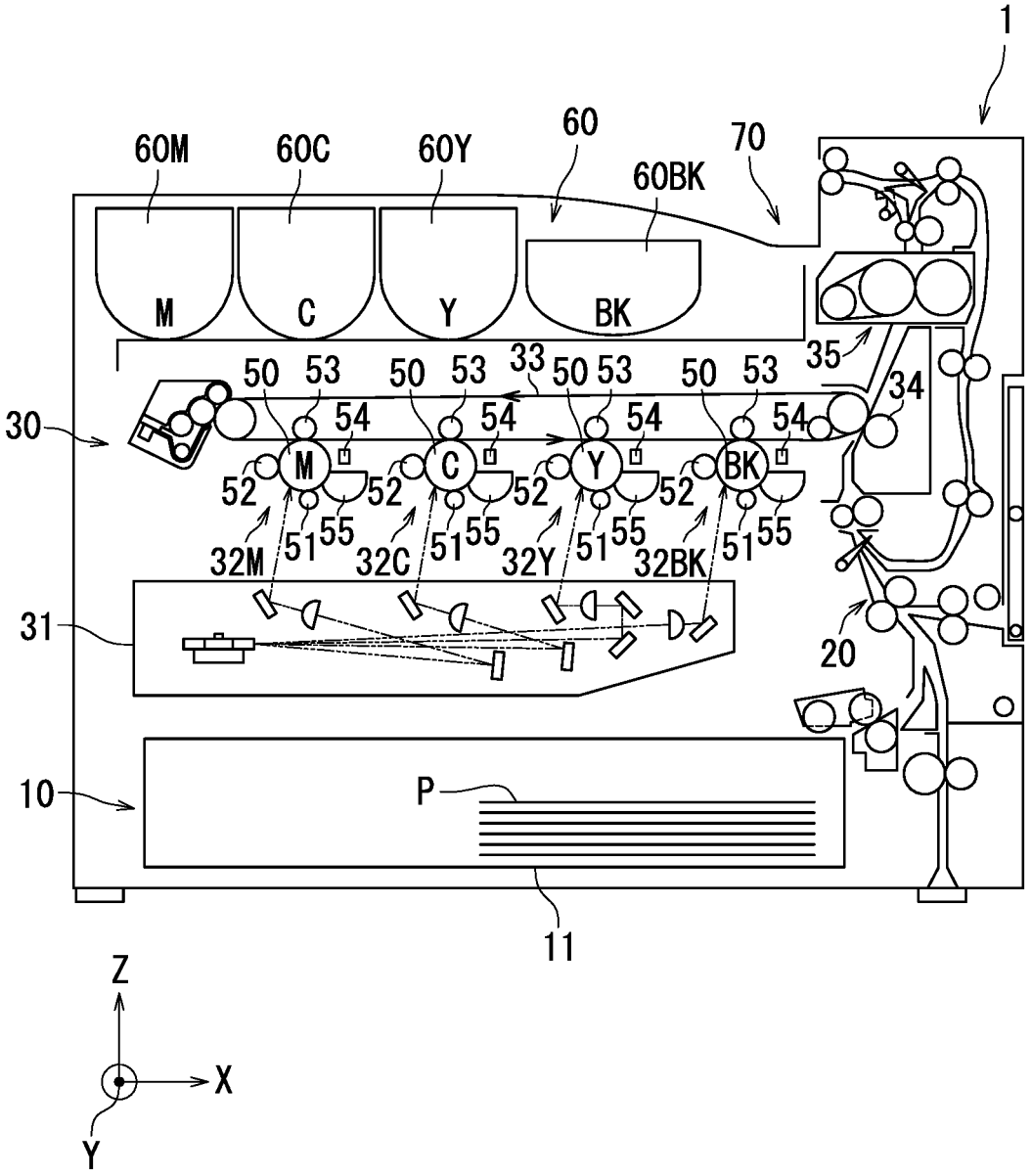
FIG. 1 is a cross-sectional view of an image forming apparatus according to an embodiment of the present disclosure.

The following first describes terms used in the present specification. The term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof.

Hereinafter, a halogen atom, an alkyl group having a carbon number of at least 1 and no greater than 8, an alkyl group having a carbon number of at least 1 and no greater than 6, an alkyl group having a carbon number of at least 1 and no greater than 5, an alkyl group having a carbon number of at least 1 and no greater than 4, an alkyl group having a carbon number of at least 1 and no greater than 3, and an alkoxy group having a carbon number of at least 1 and no greater than 4 each refer to the following, unless otherwise stated.

Examples of halogen atoms (halogen groups) include a fluorine atom (a fluoro group), a chlorine atom (a chloro group), a bromine atom (a bromo group), and an iodine atom (an iodine group).

An alkyl group having a carbon number of at least 1 and no greater than 8, an alkyl group having a carbon number of at least 1 and no greater than 6, an alkyl group having a carbon number of at least 1 and no greater than 5, an alkyl group having a carbon number of at least 1 and no greater than 4, and an alkyl group having a carbon number of at least 1 and no greater than 3 as used herein each refer to an unsubstituted straight chain or branched chain alkyl group. Examples of the alkyl group having a carbon number of at least 1 and no greater than 8 include a methyl group, an ethyl group, an n-propyl group, an isopropyl group, an n-butyl group, a sec-butyl group, a tert-butyl group, an n-pentyl group, an isopentyl group, a neopentyl group, a 1,1-dimethylpropyl group, a 1,2-dimethylpropyl group, a straight chain or branched chain hexyl group, a straight chain or branched chain heptyl group, and a straight chain or branched chain octyl group. Out of the chemical groups listed as examples of the alkyl group having a carbon number of at least 1 and no greater than 8, the chemical groups having a carbon number of at least 1 and no greater than 6 are examples of the alkyl group having a carbon number of at least 1 and no greater than 6, the chemical groups having a carbon number of at least 1 and no greater than 5 are examples of the alkyl group having a carbon number of at least 1 and no greater than 5, the chemical groups having a carbon number of at least 1 and no greater than 4 are examples of the alkyl group having a carbon number of at least 1 and no greater than 4, and the chemical groups having a carbon number of at least 1 and no greater than 3 are examples of the alkyl group having a carbon number of at least 1 and no greater than 3.

An alkoxy group having a carbon number of at least 1 and no greater than 4 as used herein refers to an unsubstituted straight chain or branched chain alkoxy group. Examples of the alkoxy group having a carbon number of at least 1 and no greater than 4 include a methoxy group, an ethoxy group, an n-propoxy group, an isopropoxy group, an n-butoxy group, a sec-butoxy group, and a tert-butoxy group. Through the above, terms used in the present specification have been described.

[Image Forming Apparatus]

The following describes an embodiment of the present disclosure with reference to the accompanying drawings. Elements in the drawings that are the same or equivalent are marked by the same reference signs and description thereof is not repeated. In the present embodiment, an X axis, a Y axis, and a Z axis are perpendicular to one another. The X axis and the Y axis are parallel with a horizontal plane, and the Z axis is parallel with a vertical line.

The following first describes an overview of an image forming apparatus 1 according to the present embodiment with reference to FIG. 1. The image forming apparatus 1 according to the present embodiment is a full-color printer. The image forming apparatus 1 includes a feed section 10, a conveyance section 20, an image forming section 30, a toner supply section 60, and an ejection section 70.

The feed section 10 includes a cassette 11 that accommodates a plurality of sheets P. The feed section 10 feeds a sheet P from the cassette 11 to the conveyance section 20. The sheet P is for example a paper sheet or a synthetic resin sheet. The conveyance section 20 conveys the sheet P to the image forming section 30.

The image forming section 30 includes a light exposure device 31, a magenta unit (referred to below as an M unit) 32M, a cyan unit (referred to below as a C unit) 32C, a yellow unit (referred to below as a Y unit) 32Y, a black unit (referred to below as a BK unit) 32BK, a transfer belt 33, a secondary transfer roller 34, and a fixing device 35. The M unit 32M, the C unit 32C, the Y unit 32Y, and the BK unit 32BK each include a photosensitive member 50, a charging roller 51, a development roller 52, a primary transfer roller 53, a static elimination lamp 54, and a cleaner 55.

The light exposure device 31 irradiates each of the M unit 32M, the C unit 32C, the Y unit 32Y, and the BK unit 32BK with light based on image data to form an electrostatic latent image in each of the M unit 32M, the C unit 32C, the Y unit 32Y, and the BK unit 32BK. The M unit 32M forms a magenta toner image based on the electrostatic latent image. The C unit 32C forms a cyan toner image based on the electrostatic latent image. The Y unit 32Y forms a yellow toner image based on the electrostatic latent image. The BK unit 32BK forms a black toner image based on the electrostatic latent image.

Each photosensitive member 50 is drum-shaped. The photosensitive member 50 rotates about a rotational axis thereof. The charging roller 51 charges a circumferential surface of the photosensitive member 50. The light exposure device 31 irradiates the charged circumferential surface of the photosensitive member 50 with light to form an electrostatic latent image on the circumferential surface of the photosensitive member 50. The development roller 52 carries a carrier CA supporting a toner T thereon by attracting the carrier CA thereto by magnetic force. A development bias (a development voltage) is applied to the development roller 52 to generate a difference between a potential of the development roller 52 and a potential of the circumferential surface of the photosensitive member 50. As a result, the toner T moves and adheres to the electrostatic latent image formed on the circumferential surface of the photosensitive member 50. As described above, the development roller 52 causes the toner T to adhere to the electrostatic latent image to develop the electrostatic latent image into a toner image. Thus, the toner image is formed on the circumferential surface of the photosensitive member 50. The primary transfer roller 53 performs primary transfer of the toner image from the circumferential surface of the photosensitive member 50 to an outer surface of the transfer belt 33. Through the primary transfer, toner images of the four colors are superimposed on one another on the outer surface of the transfer belt 33. The toner images of the four colors are a magenta toner image, a cyan toner image, a yellow toner image, and a black toner image. A color toner image is formed on the outer surface of the transfer belt 33 through the primary transfer. The secondary transfer roller 34 performs secondary transfer of the color toner image from the outer surface of the transfer belt 33 to the sheet P. The fixing device 35 applies heat and pressure to the sheet P to fix the color toner image to the sheet P. The sheet P with the color toner image fixed thereto is ejected by the ejection section 70. After the primary transfer, the static elimination lamp 54 in each of the M unit 32M, the C unit 32C, the Y unit 32Y, and the BK unit 32BK eliminates static electricity from the circumferential surface of the corresponding photosensitive member 50. After the static elimination, each cleaner 55 collects residual toner T on the circumferential surface of the corresponding photosensitive member 50.

The toner supply section 60 includes a cartridge 60M containing a magenta toner T, a cartridge 60C containing a cyan toner T, a cartridge 60Y containing a yellow toner T, and a cartridge 60BK containing a black toner T. The cartridge 60M, the cartridge 60C, the cartridge 60Y, and the cartridge 60BK respectively supply the toners T to the development rollers 52 of the M unit 32M, the C unit 32C, the Y unit 32Y, and the BK unit 32BK.

The charging roller 51 is equivalent to what may be referred to as a charger. The development roller 52 is equivalent to what may be referred to as a development device. The primary transfer roller 53 is equivalent to what may be referred to as a primary transfer device. The secondary transfer roller 34 is equivalent to what may be referred to as a secondary transfer device. The static elimination lamp 54 is equivalent to what may be referred to as a static elimination device. The cleaner 55 is equivalent to what may be referred to as a cleaning device. The sheet P is equivalent to what may be referred to as a recording medium.

Figure 2:
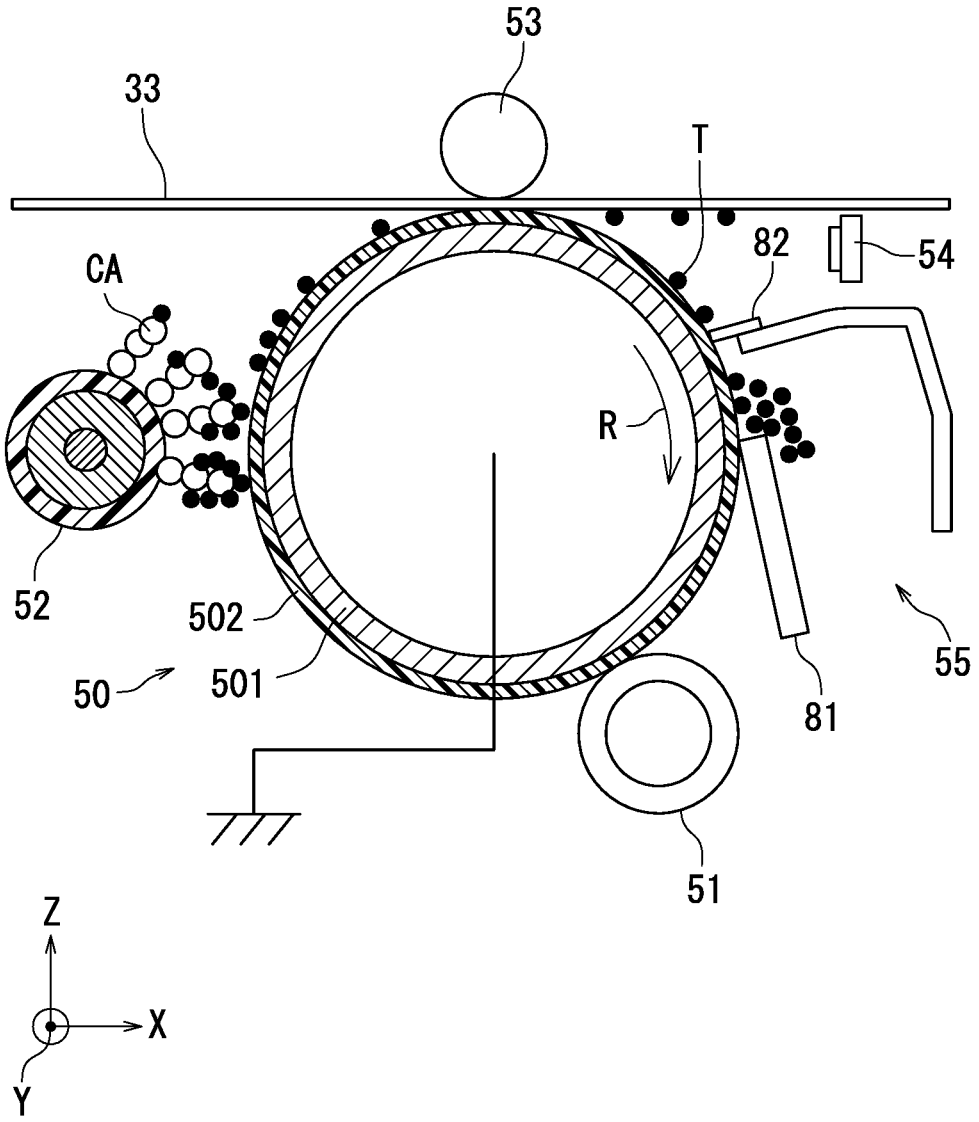
FIG. 2 is a diagram illustrating a photosensitive member included in the image forming apparatus illustrated in FIG. 1 and elements around the photosensitive member.

The following further describes the image forming apparatus 1 according to the present embodiment with reference to FIG. 2. FIG. 2 illustrates the photosensitive member 50 and elements around the photosensitive member 50. The image forming apparatus 1 according to the present embodiment includes the photosensitive members 50, each of which is equivalent to the image bearing member, and cleaning blades 81, each of which is equivalent to the cleaning member. Each of the cleaning blades 81 is pressed against the circumferential surface of the corresponding photosensitive member 50 and collects residual toner T on the circumferential surface of the photosensitive member 50. The toner T has a number average roundness of at least 0.965 and no greater than 0.998. The toner T has a volume median diameter (also referred to below as $D_{50}$) of at least 4.0 μm and no greater than 7.0 μm. Note that $D_{50}$ of the toner T is a value of particle diameter at 50% of cumulative distribution of a volume distribution of the toner T measured using a particle diameter distribution analyzer.

The toner T having a number average roundness in the above-specified range and a $D_{50}$ in the above-specified range has a small particle diameter and a high roundness. Such a toner T easily passes through a gap between the cleaning blade 81 and the circumferential surface of the photosensitive member 50, often causing insufficient cleaning. In the image forming apparatus 1 according to the present embodiment, therefore, a linear pressure of the cleaning blades 81 on the circumferential surfaces of the respective photosensitive members 50 is at least 10 N/m and no greater than 40 N/m. As a result of each cleaning blade 81 being tightly pressed against the corresponding photosensitive member 50 at a linear pressure in the above-specified range, it is possible to eliminate or extremely reduce the gap between the cleaning blade 81 and the circumferential surface of the photosensitive member 50. It is therefore possible to ensure cleanability to a practical or higher degree even if the toner T having a number average roundness in the above-specified range and a $D_{50}$ in the above-specified range is used.

However, the present inventors' study has revealed that a higher linear pressure (for example a linear pressure of at least 10 N/m and no greater than 40 N/m) of the cleaning blade 81 on the circumferential surface of the photosensitive member 50 is more likely to lead to occurrence of a ghost image. The ghost image refers to a phenomenon described as appearance of a residual image along with an output image (an image formed on a sheet P), which in other words is reappearance of an image formed during a previous rotation of the photosensitive member 50. A ghost image for example occurs due to non-uniform charging of the circumferential surface of the photosensitive member 50, which may be caused by a change in charge injection to a photosensitive layer 502 of the photosensitive member 50, residual charge present within the photosensitive layer 502, or flow of transfer current made non-uniform depending on presence or absence of a toner image on the photosensitive layer 502.

The present inventors' study has also revealed that occurrence of a ghost image is more significant in the case of the photosensitive member 50 having the photosensitive layer 502, which is a single-layer photosensitive layer, than in the case of a photosensitive member having a multi-layer photosensitive layer. The single-layer photosensitive layer 502 is relatively thick. The thicker the photosensitive layer 502 is, the more easily electrons and holes generated from a charge generating material are trapped by residual charge in the photosensitive layer 502 during transport thereof by an electron transport material and a hole transport material. The trapped electrons and holes prevent the photosensitive member 50 from being uniformly charged, causing a ghost image. The present inventors' study has further revealed that in the photosensitive member 50 including the single-layer photosensitive layer 502, the degree to which a ghost image occurs increases with an increase in the degree of abrasion of the photosensitive layer 502 with the cleaning blade 81.

The present inventors therefore made intensive study on the photosensitive member 50 capable of inhibiting occurrence of a ghost image even if the linear pressure of the cleaning blade 81 on the circumferential surface of the photosensitive member 50 is high (for example, a linear pressure of at least 10 N/m and no greater than 40 N/m) and the photosensitive member 50 has the single-layer photosensitive layer 502. The present inventors then found that occurrence of a ghost image can be inhibited as long as the photosensitive member 50 satisfies mathematical formulae (1), (2), and (3) described below, even if the linear pressure of the cleaning blade 81 is at least 10 N/m and no greater than 40 N/m.

<Photosensitive Member>

Figure 3:
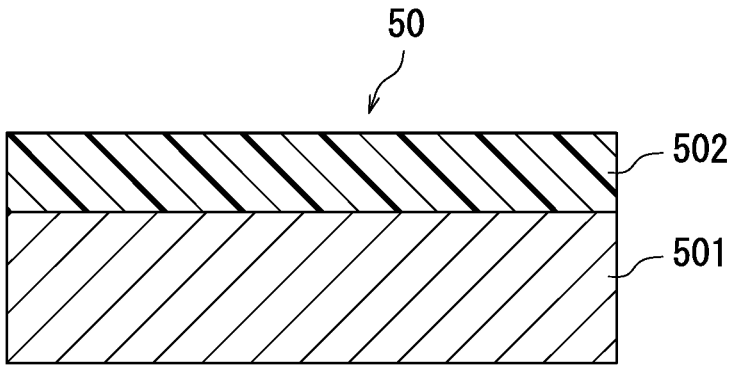
FIG. 3 is a partial cross-sectional view of an example of the photosensitive member included in the image forming apparatus illustrated in FIG. 1.
Figure 4:
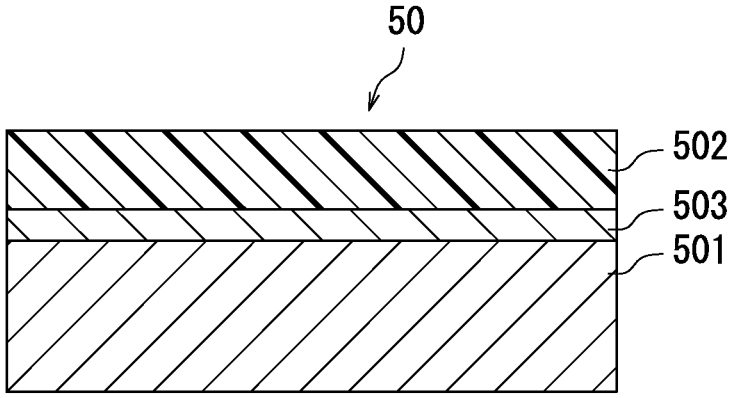
FIG. 4 is a partial cross-sectional view of an example of the photosensitive member included in the image forming apparatus illustrated in FIG. 1.
Figure 5:
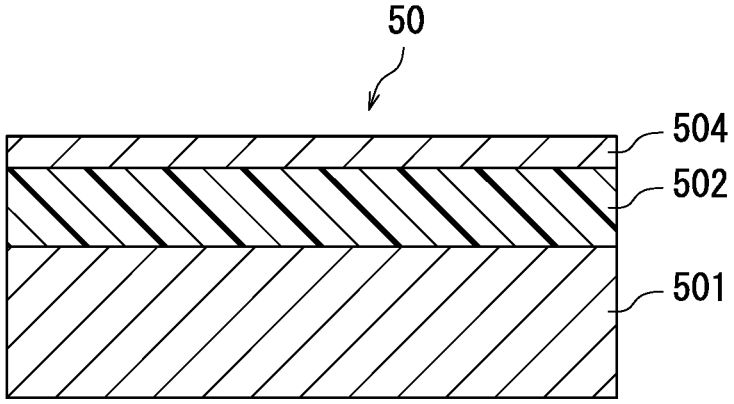
FIG. 5 is a partial cross-sectional view of an example of the photosensitive member included in the image forming apparatus illustrated in FIG. 1.

The following describes the photosensitive member 50 included in the image forming apparatus 1 with reference to FIGS. 3 to 5. FIGS. 3 to 5 are each a partial cross-sectional view of an example of the photosensitive member 50. The photosensitive member 50 is for example an organic photoconductor (OPC) drum.

As illustrated in FIG. 3, the photosensitive member 50 for example includes a conductive substrate 501 and the photosensitive layer 502. The photosensitive layer 502 is a single-layer (one-layer) photosensitive layer. The photosensitive member 50 is a single-layer electrophotographic photosensitive member including the single-layer photosensitive layer 502. No particular limitations are placed on the thickness of the photosensitive layer 502. The photosensitive layer 502 preferably has a thickness of at least 5 μm and no greater than 100 μm, and more preferably at least 10 μm and no greater than 50 μm.

The photosensitive member 50 may include an intermediate layer 503 (an undercoat layer) as well as the conductive substrate 501 and the photosensitive layer 502 as illustrated in FIG. 4. The intermediate layer 503 is disposed between the conductive substrate 501 and the photosensitive layer 502. The photosensitive layer 502 may be disposed directly on the conductive substrate 501 as illustrated in FIG. 3. Alternatively, the photosensitive layer 502 may be disposed indirectly on the conductive substrate 501 with the intermediate layer 503 therebetween as illustrated in FIG. 4. The intermediate layer 503 may be a single-layer intermediate layer or a multi-layer intermediate layer.

The photosensitive member 50 may include a protective layer 504 as well as the conductive substrate 501 and the photosensitive layer 502 as illustrated in FIG. 5. The protective layer 504 is disposed on the photosensitive layer 502. The protective layer 504 may be a single-layer protective layer or a multi-layer protective layer.

The photosensitive layer 502 contains a charge generating material, a hole transport material, an electron transport material, and a binder resin. Ionization potential $Ip_{HTM}$ of the hole transport material contained in the photosensitive member 50 and ionization potential $Ip_{CGM}$ of the charge generating material contained in the photosensitive member 50 satisfy mathematical formulae (1), (2), and (3) shown below.

$$Ip_{HTM} \geq 5.30 \text{ eV} \quad (1)$$

$$Ip_{CGM} \geq 5.30 \text{ eV} \quad (2)$$

$$0.09 \text{ eV} \leq |Ip_{HTM} - Ip_{CGM}| \leq 0.30 \text{ eV} \quad (3)$$

$Ip_{HTM}$ in mathematical formula (1) and $Ip_{CGM}$ in mathematical formula (2) are each a positive value. $|Ip_{HTM} - Ip_{CGM}|$ in mathematical formula (3) represents an absolute value of the difference between the ionization potential $Ip_{HTM}$ of the hole transport material and the ionization potential $Ip_{CGM}$ of the charge generating material.

A cause of occurrence of a ghost image is a change in charge injection to the photosensitive layer 502 of the photosensitive member 50. The present inventors found that the charge injection to the photosensitive layer 502 drops below a desired level due to the circumferential surface of the photosensitive member 50 being scrubbed by the cleaning blade 81. The present inventors then found that it is possible to prevent the charge injection from dropping below the desired level due to the scrubbing by the cleaning blade 81 through a high ionization potential $Ip_{HTM}$ of the hole transport material satisfying mathematical formula (1), a high ionization potential $Ip_{CGM}$ of the charge generating material satisfying mathematical formula (2), and smooth charge transport between the charge generating material and the hole transport material satisfying mathematical formula (3). The image forming apparatus 1 according to the present embodiment can inhibit occurrence of a ghost image even if the cleaning blade 81 is tightly pressed against the photosensitive member 50 (for example, at a linear pressure of at least 10 N/m and no greater than 40 N/m) as long as the charge injection is prevented from dropping below the desired level. Note that the ionization potential $Ip_{HTM}$ of the hole transport material and the ionization potential $Ip_{CGM}$ of the charge generating material can be measured according to a method described in association with Examples.

Regarding mathematical formula (1), in order to inhibit occurrence of a ghost image, the ionization potential $Ip_{HTM}$ of the hole transport material is preferably at least 5.40 eV, more preferably at least 5.50 eV, still more preferably at least 5.55 eV, and particularly preferably at least 5.60 eV. No particular limitations are placed on the upper limit of the ionization potential $Ip_{HTM}$ of the hole transport material. For example, the ionization potential $Ip_{HTM}$ of the hole transport material may be no greater than 6.00 eV.

Regarding mathematical formula (2), in order to inhibit occurrence of a ghost image, the ionization potential $Ip_{CGM}$ of the charge generating material is preferably at least 5.40 eV. No particular limitations are placed on the upper limit of the ionization potential $Ip_{CGM}$ of the charge generating material. For example, the ionization potential $Ip_{CGM}$ of the charge generating material may be no greater than 6.00 eV.

Regarding mathematical formula (3), in order to inhibit occurrence of a ghost image, the value $|Ip_{HTM} - Ip_{CGM}|$ is preferably at least 0.05, more preferably at least 0.10, and still more preferably at least 0.15.

The circumferential surface of the photosensitive member 50 preferably has a surface friction coefficient of at least 0.20 and no greater than 0.80, more preferably at least 0.20 and no greater than 0.60, and still more preferably at least 0.20 and no greater than 0.58. As a result of the surface friction coefficient of the circumferential surface of the photosensitive member 50 being no greater than 0.80, adhesion of the toner T to the circumferential surface of the photosensitive member 50 is low enough to further prevent insufficient cleaning. As a result of the surface friction coefficient of the circumferential surface of the photosensitive member 50 being no greater than 0.80, friction force of the cleaning blade 81 against the circumferential surface of the photosensitive member 50 is low enough to further reduce abrasion of the photosensitive layer 502 of the photosensitive member 50. No particular limitations are placed on the lower limit of the surface friction coefficient of the circumferential surface of the photosensitive member 50. For example, the surface friction coefficient of the circumferential surface of the photosensitive member 50 may be at least 0.20. The surface friction coefficient of the circumferential surface of the photosensitive member 50 can be measured according to a method described in association with Examples.

In order to obtain a high-quality output image, a post-irradiation potential of the circumferential surface of the photosensitive member 50 is preferably at least +50 V and no greater than +300 V, and more preferably at least +80 V and no greater than +200 V. The post-irradiation potential is a potential of an irradiated region of the circumferential surface of the photosensitive member 50 irradiated with light by the light exposure device 31. The post-irradiation potential is measured before the development and after the light irradiation. The post-irradiation potential of the photosensitive member 50 can be measured according to a method described in association with Examples.

The photosensitive layer 502 preferably has a Martens hardness of at least 150 $N/mm^2$, more preferably at least 180 $N/mm^2$, still more preferably at least 200 $N/mm^2$, and further preferably at least 220 $N/mm^2$. As a result of the Martens hardness of the photosensitive layer 502 being at least 150 $N/mm^2$, the abrasion amount of the photosensitive layer 502 is reduced, improving abrasion resistance of the photosensitive member 50. No particular limitations are placed on the upper limit of the Martens hardness of the photosensitive layer 502. For example, the Martens hardness of the photosensitive layer 502 may be no greater than 250 $N/mm^2$. The Martens hardness of the photosensitive layer 502 can be measured according to a method described in association with Examples.

The photosensitive layer 502 contains a charge generating material, a hole transport material, an electron transport material, and a binder resin. The photosensitive layer 502 may further contain an additive as necessary. The following describes the charge generating material, the hole transport material, the electron transport material, the binder resin, and the additive, and preferable combinations of the materials.

(Charge Generating Material)

No particular limitations are placed on the charge generating material so long as mathematical formula (2) is satisfied. Examples of charge generating materials that can be used include phthalocyanine-based pigments, perylene-based pigments, bisazo pigments, tris-azo pigments, dithioketopyrrolopyrrole pigments, metal-free naphthalocyanine pigments, metal naphthalocyanine pigments, squaraine pigments, indigo pigments, azulenium pigments, cyanine pigments, powders of inorganic photoconductive materials (specific examples include selenium, selenium-tellurium, selenium-arsenic, cadmium sulfide, and amorphous silicon), pyrylium pigments, anthanthrone-based pigments, triphenylmethane-based pigments, threne-based pigments, toluidine-based pigments, pyrazoline-based pigments, and quinacridone-based pigments. The photosensitive layer 502 may contain only one charge generating material or may contain two or more charge generating materials.

Examples of phthalocyanine-based pigments satisfying mathematical formula (2) that are preferable in terms of inhibiting occurrence of a ghost image include titanyl phthalocyanine and chloroindium phthalocyanine.

The titanyl phthalocyanine may have a crystal structure. Examples of titanyl phthalocyanine having a crystal structure include titanyl phthalocyanine having an α-form crystal structure, titanyl phthalocyanine having a β-form crystal structure, and titanyl phthalocyanine having a Y-form crystal structure (also referred to below as α-form titanyl phthalocyanine, β-form titanyl phthalocyanine, and Y-form titanyl phthalocyanine, respectively). Preferably, the titanyl phthalocyanine is Y-form titanyl phthalocyanine.

Y-form titanyl phthalocyanine for example exhibits a main peak at a Bragg angle (2θ±0.2°) of 27.2° in a CuKα characteristic X-ray diffraction spectrum. The main peak in the CuKα characteristic X-ray diffraction spectrum refers to a peak having a highest or second highest intensity in a range of Bragg angles (2θ±0.2°) from 3° to 40°.

The following describes an example of a method for measuring the CuKα characteristic X-ray diffraction spectrum. A sample (titanyl phthalocyanine) is loaded into a sample holder of an X-ray diffraction spectrometer (for example, "RINT (registered Japanese trademark) 1100", product of Rigaku Corporation), and an X-ray diffraction spectrum is measured using a Cu X-ray tube, a tube voltage of 40 kV, a tube current of 30 mA, and CuKα characteristic X-rays having a wavelength of 1.542 Å. The measurement range (2θ) is for example from 3° to 40° (start angle: 3°, stop angle: 40°), and the scanning rate is for example 10°/minute.

Y-form titanyl phthalocyanine is for example classified into the following three types (A) to (C) based on thermal characteristics in differential scanning calorimetry (DSC) spectra.

(A) Y-form titanyl phthalocyanine that exhibits a peak in a range of from 50° C. to 270° C. in a differential scanning calorimetry spectrum thereof, other than a peak resulting from vaporization of adsorbed water.

(B) Y-form titanyl phthalocyanine that does not exhibit a peak in a range of from 50° C. to 400° C. in a differential scanning calorimetry spectrum thereof, other than a peak resulting from vaporization of adsorbed water.

(C) Y-form titanyl phthalocyanine that does not exhibit a peak in a range of from 50° C. to 270° C. and exhibits a peak in a range of higher than 270° C. and no higher than 400° C. in a differential scanning calorimetry spectrum thereof, other than a peak resulting from vaporization of adsorbed water.

Y-form titanyl phthalocyanine is preferable that does not exhibit a peak in a range of from 50° C. to 270° C. and exhibits a peak in a range of higher than 270° C. and no higher than 400° C. in a differential scanning calorimetry spectrum thereof, other than a peak resulting from vaporization of adsorbed water. The Y-form titanyl phthalocyanine that exhibits such a peak is preferably Y-form titanyl phthalocyanine that exhibits a single peak in a range of higher than 270° C. and no higher than 400° C., and more preferably Y-form titanyl phthalocyanine that exhibits a single peak at 296° C.

The following describes an example of a method for measuring a differential scanning calorimetry spectrum. A sample (titanyl phthalocyanine) is loaded into a sample pan, and a differential scanning calorimetry spectrum is measured using a differential scanning calorimeter (for example, "TAS-200 DSC8230D", product of Rigaku Corporation). The measurement range is for example from 40° C. to 400° C. The heating rate is for example 20° C./minute.

The charge generating material is preferably contained in an amount of greater than 0.0% by mass and no greater than 1.0% by mass relative to mass of the photosensitive layer 502.

(Hole Transport Material)

No particular limitations are placed on the hole transport material so long as mathematical formula (1) is satisfied. Examples of hole transport materials that can be used include nitrogen-containing cyclic compounds and condensed polycyclic compounds. Examples of nitrogen-containing cyclic compounds and condensed polycyclic compounds that can be used include triphenylamine derivatives, diamine derivatives (specific examples include N,N,N',N'-tetraphenylbenzidine derivatives, N,N,N',N'-tetraphenylphenylenediamine derivatives, N,N,N',N'-tetraphenylnaphtylenediamine derivatives, di(aminophenylethenyl) benzene derivatives, and N,N,N',N'-tetraphenylphenanthrylenediamine derivatives), oxadiazole-based compounds (specific examples include 2,5-di(4-methylaminophenyl)-1,3,4-oxadiazole), styryl-based compounds (specific examples include 9-(4-diethylaminostyryl)anthracene), carbazole-based compounds (specific examples include polyvinyl carbazole), organic polysilane compounds, pyrazoline-based compounds (specific examples include 1-phenyl-3-(p-dimethylaminophenyl) pyrazoline), hydrazone-based compounds, indole-based compounds, oxazole-based compounds, isoxazole-based compounds, thiazole-based compounds, thiadiazole-based compounds, imidazole-based compounds, pyrazole-based compounds, and triazole-based compounds. The photosensitive layer 502 may contain only one hole transport material or may contain two or more hole transport materials.

Examples of hole transport materials that are preferable in terms of inhibiting occurrence of a ghost image include compounds represented by general formulae (10) and (11) (also referred to below as hole transport materials (10) and (11), respectively).

(10)

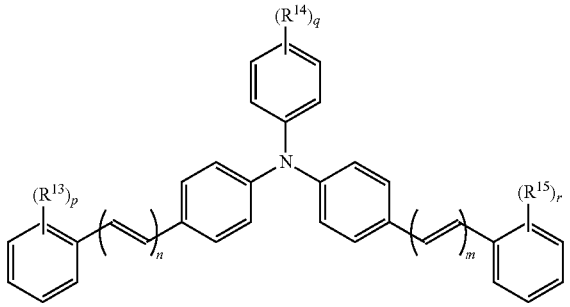

In general formula (10), $R^{13}$ to $R^{15}$ each represent, independently of one another, an alkyl group having a carbon number of at least 1 and no greater than 4 or an alkoxy group having a carbon number of at least 1 and no greater than 4. m and n each represent, independently of one another, an integer of at least 1 and no greater than 3. p and r each represent, independently of one another, 0 or 1. q represents an integer of at least 0 and no greater than 2. When q represents 2, two chemical groups $R^{14}$ may be the same as or different from one another.

In general formula (10), $R^{14}$ preferably represents an alkyl group having a carbon number of at least 1 and no greater than 4, and more preferably a methyl group, an ethyl group, or an n-butyl group. Preferably, q represents 1 or 2. Preferably, p and r each represent 0. Preferably, m and n each represent 1 or 2.

Examples of preferable hole transport materials (10) include compounds represented by chemical formulae (10-1), (10-2), and (10-3) (also referred to below as hole transport materials (10-1), (10-2), and (10-3), respectively).

(10-1)

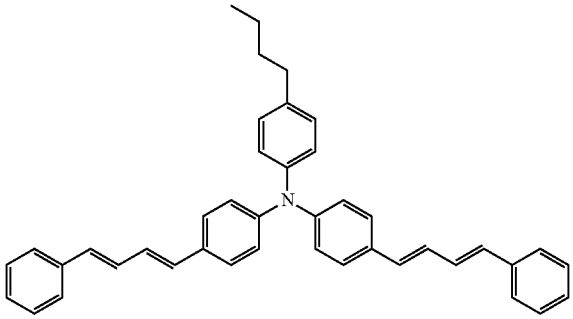

(10-2)

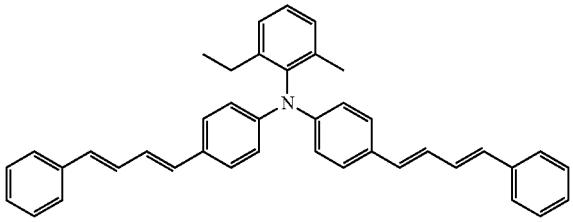

(10-3)

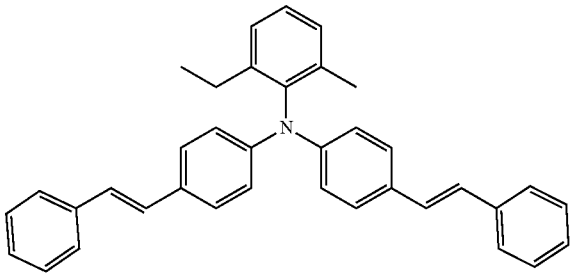

-continued (11)

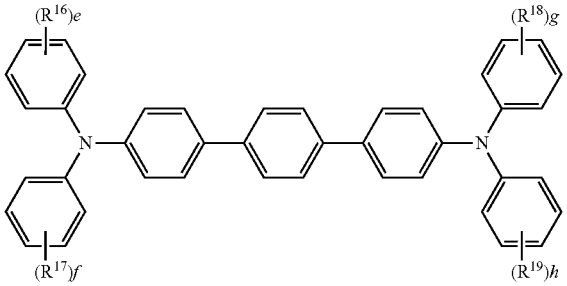

In general formula (11), $R^{16}$ to $R^{19}$ each represent, independently of one another, an alkyl group having a carbon number of at least 1 and no greater than 6. e, f, g, and h each represent, independently of one another, an integer of at least 0 and no greater than 5. When e represents an integer of at least 2 and no greater than 5, chemical groups $R^{16}$ may be the same as or different from one another. When f represents an integer of at least 2 and no greater than 5, chemical groups $R^{17}$ may be the same as or different from one another. When g represents an integer of at least 2 and no greater than 5, chemical groups $R^{18}$ may be the same as or different from one another. When h represents an integer of at least 2 and no greater than 5, chemical groups $R^{19}$ may be the same as or different from one another.

In general formula (11), $R^{16}$ to $R^{19}$ are each preferably represent an alkyl group having a carbon number of at least 1 and no greater than 3, and more preferably a methyl group. Preferably, e, f, g, and h each represent, independently of one another, 0 or 1. Preferably, e, f, and g each represent 1, and h represents 0.

Examples of preferable hole transport materials (11) include a compound represented by chemical formula (11-1) (also referred to below as a hole transport material (11-1)).

(11-1)

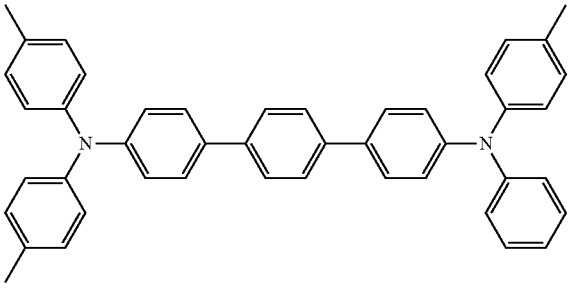

The hole transport material is preferably contained in an amount of greater than 0.0% by mass and no greater than 35.0% by mass relative to the mass of the photosensitive layer 502, and more preferably in an amount of at least 10.0% by mass and no greater than 30.0% by mass.

(Electron Transport Material)

Examples of electron transport materials that can be used include quinone-based compounds, diimide-based compounds, hydrazone-based compounds, malononitrile-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4, 8-trinitrothioxanthone, dinitrobenzene, dinitroacridine, succinic anhydride, maleic anhydride, and dibromomaleic anhydride. Examples of quinone-based compounds that can be used include diphenoquinone-based compounds, azoquinone-based compounds, anthraquinone-based compounds, naphthoquinone-based compounds, nitroanthraquinone-based compounds, and dinitroanthraquinone-based compounds. The photosensitive layer 502 may contain only one electron transport material or may contain two or more electron transport materials.

Examples of electron transport materials that are preferable in terms of inhibiting occurrence of a ghost image include compounds represented by general formulae (1), (2), and (3) (also referred to below as electron transport materials (1), (2), and (3), respectively).

(1)

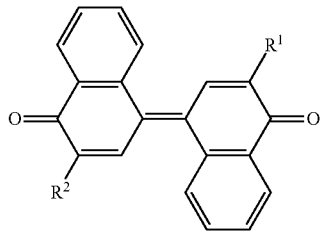

(2)

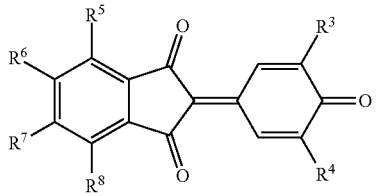

(3)

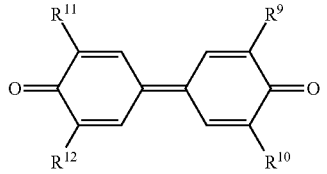

In general formulae (1) to (3), $R^1$ to $R^4$ and $R^9$ to $R^{12}$ each represent, independently of one another, an alkyl group having a carbon number of at least 1 and no greater than 8. $R^5$ to $R^8$ each represent, independently of one another, a hydrogen atom, a halogen atom, or an alkyl group having a carbon number of at least 1 and no greater than 4.

In general formulae (1) to (3), the alkyl group having a carbon number of at least 1 and no greater than 8 that may be represented by $R^1$ to $R^4$ and $R^9$ to $R^{12}$ is preferably an alkyl group having a carbon number of at least 1 and no greater than 5, and more preferably a methyl group, a tert-butyl group, or a 1,1-dimethylpropyl group. Preferably, $R^5$ to $R^8$ are each a hydrogen atom.

Preferably, the electron transport material (1) is a compound represented by chemical formula (1-1) (also referred to below as an electron transport material (1-1)). Preferably, the electron transport material (2) is a compound represented by chemical formula (2-1) (also referred to below as an electron transport material (2-1)). Preferably, the electron transport material (3) is a compound represented by chemical formula (3-1) (also referred to below as an electron transport material (3-1)).

(1-1)

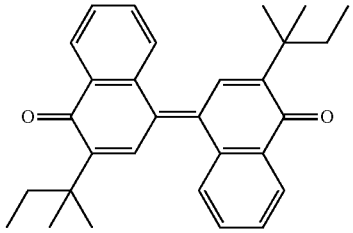

(2-1)

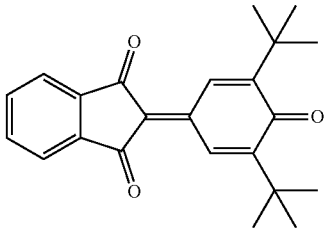

(3-1)

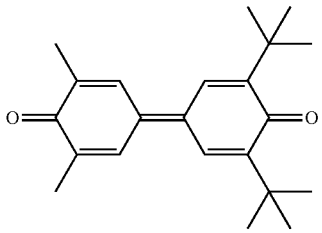

In order to inhibit occurrence of a ghost image, the photosensitive layer 502 preferably contains at least one of the electron transport materials (1) and (2), and more preferably contains both (two) of the electron transport materials (1) and (2) as the electron transport material.

In order to inhibit occurrence of a ghost image, the photosensitive layer 502 preferably contains at least one of the electron transport materials (1-1) and (2-1), and more preferably contains both (two) of the electron transport materials (1-1) and (2-1) as the electron transport material.

The electron transport material is preferably contained in an amount of at least 5.0% by mass and no greater than 50.0% by mass relative to the mass of the photosensitive layer 502, and more preferably in an amount of at least 20.0% by mass and no greater than 30.0% by mass. In the case of the photosensitive layer 502 containing two or more electron transport materials, the amount of the electron transport material refers to a total amount of the two or more electron transport materials.

(Binder Resin)

Examples of binder resins that can be used include thermoplastic resins, thermosetting resins, and photocurable resins. Examples of thermoplastic resins that can be used include polycarbonate resins, polyarylate resins, styrene-butadiene copolymers, styrene-acrylonitrile copolymers, styrene-maleate copolymers, acrylic acid polymers, styrene-acrylate copolymers, polyethylene resins, ethylene-vinyl acetate copolymers, chlorinated polyethylene resins, polyvinyl chloride resins, polypropylene resins, ionomer resins, vinyl chloride-vinyl acetate copolymers, alkyd resins, polyamide resins, urethane resins, polysulfone resins, diallyl phthalate resins, ketone resins, polyvinyl butyral resins, polyester resins, and polyether resins. Examples of thermosetting resins that can be used include silicone resins, epoxy resins, phenolic resins, urea resins, and melamine resins. Examples of photocurable resins that can be used include acrylic acid adducts of epoxy compounds and acrylic acid adducts of urethane compounds. The photosensitive layer 502 may contain only one binder resin or may contain two or more binder resins.

In order to inhibit occurrence of a ghost image, preferably, the binder resin includes a polyarylate resin including a repeating unit represented by general formula (20) (also referred to below as a polyarylate resin (20)).

(20)

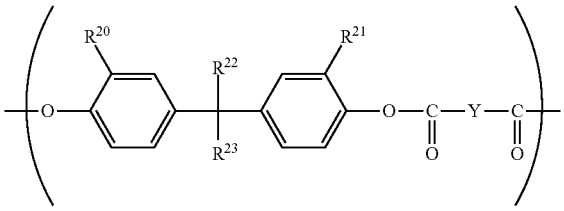

In general formula (20), $R^{20}$ and $R^{21}$ each represent, independently of one another, a hydrogen atom or an alkyl group having a carbon number of at least 1 and no greater than 4. $R^{22}$ and $R^{23}$ each represent, independently of one another, a hydrogen atom, a phenyl group, or an alkyl group having a carbon number of at least 1 and no greater than 4. $R^{22}$ and $R^{23}$ may be bonded to one another to form a divalent group represented by general formula (W). Y represents a divalent group represented by chemical formula (Y1), (Y2), (Y3), (Y4), (Y5), or (Y6).

(W)

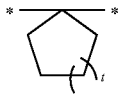

In general formula (W), t represents an integer of at least 1 and no greater than 3. Asterisks each represent a bond. Specifically, the asterisks in general formula (W) each represent a bond to a carbon atom bonded to Y in general formula (20).

(Y1)

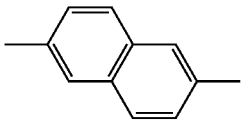

(Y2)

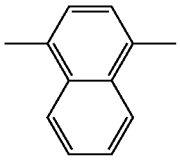

-continued (Y3)

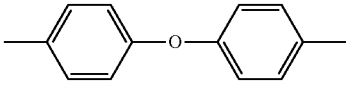

(Y4)

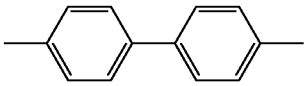

(Y5)

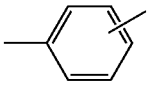

(Y6)

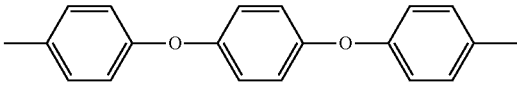

In general formula (20), $R^{20}$ and $R^{21}$ are each preferably an alkyl group having a carbon number of at least 1 and no greater than 4, and more preferably a methyl group. $R^{22}$ and $R^{23}$ are preferably bonded to one another to form a divalent group represented by general formula (W). Preferably, Y is a divalent group represented by chemical formula (Y1) or (Y3). In general formula (W), t is preferably 2.

Preferably, the polyarylate resin (20) only includes a repeating unit represented by general formula (20). However, the polyarylate resin (20) may further include another repeating unit. A ratio (mole fraction) of the number of the repeating units represented by general formula (20) to the total number of repeating units in the polyarylate resin (20) is preferably at least 0.80, more preferably at least 0.90, and still more preferably 1.00. The polyarylate resin (20) may only include one repeating unit represented by general formula (20) or may include a plurality of (for example, two) repeating units each represented by general formula (20).

Note that in the present specification, the ratio (mole fraction) of the number of the repeating units represented by general formula (20) to the total number of repeating units in the polyarylate resin (20) is not a value obtained from one resin chain but a number average obtained from all molecules of the polyarylate resin (20) (a plurality of resin chains) contained in the photosensitive layer 502. The mole fraction can for example be calculated from a $^{1}$H-NMR spectrum of the polyarylate resin (20) measured using a proton nuclear magnetic resonance spectrometer.

Examples of preferable repeating units represented by general formula (20) include repeating units represented by chemical formulae (20-*a*) and (20-*b*) (also referred to below as repeating units (20-*a*) and (20-*b*), respectively). The polyarylate resin (20) preferably includes at least one of the repeating units (20-*a*) and (20-*b*), and more preferably includes both of the repeating units (20-*a*) and (20-*b*).

(20-a)

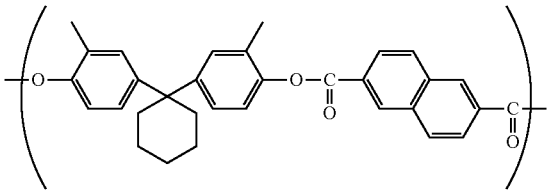

-continued (20-b)

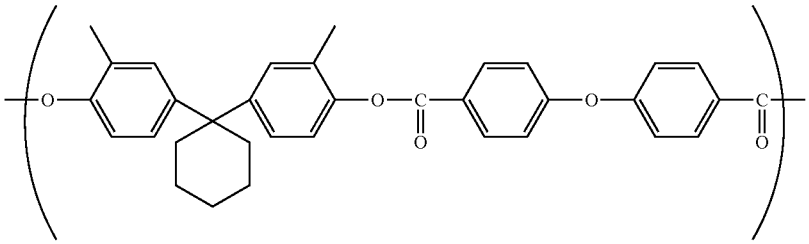

In the case of the polyarylate resin (20) including both of the repeating units (20-*a*) and (20-*b*), no particular limitations are placed on the sequence of the repeating units (20-*a*) and (20-*b*). The polyarylate resin (20) including the repeating units (20-*a*) and (20-*b*) may be any of a random copolymer, a block copolymer, a periodic copolymer, or an alternating copolymer.

Examples of preferable polyarylate resins (20) including both of the repeating units (20-*a*) and (20-*b*) include a polyarylate resin represented by general formula (20-1).

(20-1)

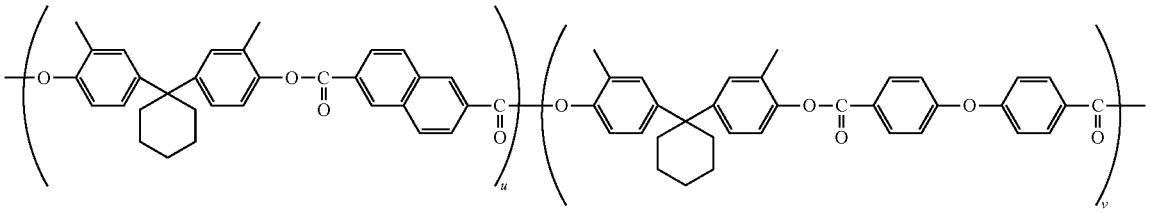

In general formula (20-1), a sum of u and v is 100. u is a number greater than or equal to 30 and less than or equal to 70.

Preferably, u is a number greater than or equal to 40 and less than or equal to 60, more preferably a number greater than or equal to 45 and less than or equal to 55, still more preferably a number greater than or equal to 49 and less than or equal to 51, and particularly preferably 50. Note that u represents a percentage of the number of the repeating units (20-*a*) relative to a sum of the number of the repeating units (20-*a*) and the number of the repeating units (20-*b*) in the polyarylate resin (20). v represents a percentage of the number of the repeating units (20-*b*) relative to the sum of the number of the repeating units (20-*a*) and the number of the repeating units (20-*b*) in the polyarylate resin (20). Examples of preferable polyarylate resins represented by general formula (20-1) include a polyarylate resin represented by general formula (20-1*a*).

(20-1a)

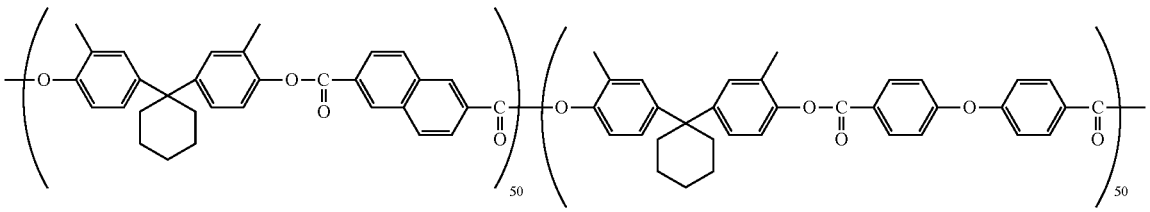

The polyarylate resin (20) may have a terminal group represented by chemical formula (Z). An asterisk in chemical formula (Z) represents a bond. Specifically, the asterisk in chemical formula (Z) represents a bond to the main chain of the polyarylate resin. In the case of the polyarylate resin (20) including the repeating unit (20-*a*), the repeating unit (20-*b*), and the terminal group represented by chemical formula (Z), the terminal group may be bonded to the repeating unit (20-*a*) or may be bonded to the repeating unit (20-*b*).

(Z)

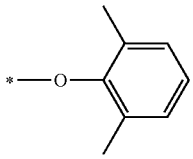

In order to inhibit occurrence of a ghost image, preferably, the polyarylate resin (20) includes a polyarylate resin having a main chain represented by general formula (20-1) and a terminal group represented by chemical formula (Z). More preferably, the polyarylate resin (20) includes a polyarylate resin having a main chain represented by general formula (20-1*a*) and a terminal group represented by chemical formula (Z).

The binder resin preferably has a viscosity average molecular weight of at least 10,000, more preferably at least 20,000, still more preferably at least 30,000, further preferably at least 50,000, and particularly preferably at least 55,000. As a result of the viscosity average molecular weight of the binder resin being at least 10,000, the photosensitive member 50 tends to have improved abrasion resistance. The viscosity average molecular weight of the binder resin is preferably no greater than 80,000, and more preferably no greater than 70,000. As a result of the viscosity average molecular weight of the binder resin being no greater than 80,000, the binder resin tends to readily dissolve in a solvent for photosensitive layer formation, facilitating formation of the photosensitive layer 502.

The binder resin is preferably contained in an amount of at least 30.0% by mass and no greater than 70.0% by mass relative to the mass of the photosensitive layer 502, and more preferably in an amount of at least 40.0% by mass and no greater than 60.0% by mass.

(Additive)

The photosensitive layer 502 may contain an additive as an optional component. Examples of additives that can be used include antidegradants (specific examples include antioxidants, radical scavengers, quenchers, and ultraviolet absorbing agents), softeners, surface modifiers, extenders, thickeners, dispersion stabilizers, waxes, donors, surfactants, and leveling agents. Only one of the additives listed above may be added to the photosensitive layer 502 independently, or two or more of the additives listed above may be added to the photosensitive layer 502.

(Combination of Materials)

In order to inhibit occurrence of a ghost image, the following combination is preferable: a charge generating material including Y-form titanyl phthalocyanine and a hole transport material including the hole transport material (10-1), the hole transport material (10-2), the hole transport material (10-3), or the hole transport material (11-1). In order to inhibit occurrence of a ghost image, the following combination is also preferable: a charge generating material including chloroindium phthalocyanine and a hole transport material including the hole transport material (10-2), the hole transport material (10-3), or the hole transport material (11-1). That is, the combination of the charge generating material and the hole transport material is preferably any one of combination examples (C-1) to (C-7) shown in Table 1.

TABLE 1

| Combination example | HTM Type | CGM Type |
|---|---|---|
| C-1 | 11-1 | InClPc |
| C-2 | 11-1 | Y-TiOPc |
| C-3 | 10-3 | InClPc |
| C-4 | 10-3 | Y-TiOPc |
| C-5 | 10-2 | InClPc |
| C-6 | 10-2 | Y-TiOPc |
| C-7 | 10-1 | Y-TiOPc |

In Table 1, "HTM" means hole transport material, "CGM" means charge generating material, "InClPc" means chloroindium phthalocyanine, and "Y-TiOPc" means Y-form titanyl phthalocyanine. Preferably, the Y-form titanyl phthalocyanine shown in Table 1 is Y-form titanyl phthalocyanine that does not exhibit a peak in a range of from 50° C. to 270° C. and that exhibits a peak in a range of higher than 270° C. and no higher than 400° C. (specifically, a single peak at 296° C.) in a differential scanning calorimetry spectrum thereof, other than a peak resulting from vaporization of adsorbed water.

In order to inhibit occurrence of a ghost image, preferably, the combination of the charge generating material and the hole transport material is any one of the combination examples (C-1) to (C-7), and the electron transport material includes both of the electron transport materials (1-1) and (2-1).

In order to inhibit occurrence of a ghost image, preferably, the combination of the charge generating material and the hole transport material is any one of the combination examples (C-1) to (C-7), and the binder resin includes a polyarylate resin having a main chain represented by general formula (20-1) and a terminal group represented by chemical formula (Z). In order to inhibit occurrence of a ghost image, more preferably, the combination of the charge generating material and the hole transport material is any one of the combination examples (C-1) to (C-7), and the binder resin includes a polyarylate resin having a main chain represented by general formula (20-1*a*) and a terminal group represented by chemical formula (Z).

In order to inhibit occurrence of a ghost image, preferably, the combination of the charge generating material and the hole transport material is any one of the combination examples (C-1) to (C-7), the binder resin includes a polyarylate resin having a main chain represented by general formula (20-1) and a terminal group represented by chemical formula (Z), and the electron transport material includes both of the electron transport materials (1-1) and (2-1). In order to inhibit occurrence of a ghost image, more preferably, the combination of the charge generating material and the hole transport material is any one of the combination examples (C-1) to (C-7), the binder resin includes a polyarylate resin having a main chain represented by general formula (20-1*a*) and a terminal group represented by chemical formula (Z), and the electron transport material includes both of the electron transport materials (1-1) and (2-1).

(Intermediate Layer)

The intermediate layer 503 for example contains inorganic particles and a resin for use in the intermediate layer 503 (intermediate layer resin). Provision of the intermediate layer 503 can facilitate flow of current generated when the photosensitive member 50 is irradiated with light and inhibit increasing resistance, while also maintaining insulation to a sufficient degree so as to inhibit occurrence of leakage current.

Examples of inorganic particles that can be used include particles of metals (specific examples include aluminum, iron, and copper), particles of metal oxides (specific examples include titanium oxide, alumina, zirconium oxide, tin oxide, and zinc oxide), and particles of non-metal oxides (specific examples include silica). Any one type of the inorganic particles listed above may be used independently, or any two or more types of the inorganic particles listed above may be used in combination. The inorganic particles may be surface-treated. No particular limitations are placed on the intermediate layer resin other than being a resin that can be used to form the intermediate layer 503.

(Production Method of Photosensitive Member)

According to an example of the production method of the photosensitive member 50, an application liquid for formation of the photosensitive layer 502 (also referred to below as an application liquid for photosensitive layer formation) is applied onto the conductive substrate 501 and dried. Through the above, the photosensitive layer 502 is formed, producing the photosensitive member 50. The application liquid for photosensitive layer formation is prepared by dissolving or dispersing a charge generating material, a hole transport material, an electron transport material, a binder resin, and an optional component as necessary in a solvent.

No particular limitations are placed on the solvent contained in the application liquid for photosensitive layer formation other than that the components of the application liquid should be soluble or dispersible in the solvent. Examples of solvents that can be used include alcohols (specific examples include methanol, ethanol, isopropanol, and butanol), aliphatic hydrocarbons (specific examples include n-hexane, octane, and cyclohexane), aromatic hydrocarbons (specific examples include benzene, toluene, and xylene), halogenated hydrocarbons (specific examples include dichloromethane, dichloroethane, carbon tetrachloride, and chlorobenzene), ethers (specific examples include dimethyl ether, diethyl ether, tetrahydrofuran, ethylene glycol dimethyl ether, diethylene glycol dimethyl ether, and propylene glycol monomethyl ether), ketones (specific examples include acetone, methyl ethyl ketone, and cyclohexanone), esters (specific examples include ethyl acetate and methyl acetate), dimethyl formaldehyde, dimethyl formamide, and dimethyl sulfoxide. Any one of the solvents listed above may be used independently, or any two or more of the solvents listed above may be used in combination. In order to improve workability in production of the photosensitive member 50, a non-halogenated solvent (a solvent other than a halogenated hydrocarbon) is preferably used.

The application liquid for photosensitive layer formation is prepared by dispersing the components in the solvent by mixing. Mixing or dispersion can for example be performed using a bead mill, a roll mill, a ball mill, an attritor, a paint shaker, or an ultrasonic disperser.

The application liquid for photosensitive layer formation may for example contain a surfactant in order to improve dispersibility of the components.

No particular limitations are placed on the method by which the application liquid for photosensitive layer formation is applied other than being a method that enables uniform application of the application liquid for photosensitive layer formation on the conductive substrate 501. Examples of application methods that can be used include blade coating, dip coating, spray coating, spin coating, and bar coating.

No particular limitations are placed on the method by which the application liquid for photosensitive layer formation is dried other than being a method that enables evaporation of the solvent in the application liquid for photosensitive layer formation. An example of a method involves heat treatment (hot-air drying) using a high-temperature dryer or a reduced pressure dryer. The heat treatment temperature is for example from 40° C. to 150° C. The heat treatment time is for example from 3 minutes to 120 minutes.

Note that the production method of the photosensitive member 50 may further include either or both of a process of forming the intermediate layer 503 and a process of forming the protective layer 504 as necessary. The process of forming the intermediate layer 503 and the process of forming the protective layer 504 are each performed according to a method appropriately selected from known methods.

Through the above, the photosensitive member 50 has been described. Referring again to FIG. 2, the following describes the toners T, the charging rollers 51, the primary transfer rollers 53, the static elimination lamps 54, and the cleaners 55 in the image forming apparatus 1.

<Toner>

The following describes the toners T that are contained in the cartridges 60M to 60BK illustrated in FIG. 1 and supplied to the circumferential surfaces of the photosensitive members 50. Each toner T includes toner particles. The toner T is a collection (a powder) of the toner particles. The toner particles each have a toner mother particle and an external additive. The toner mother particle includes at least one of a binder resin, a releasing agent, a colorant, a charge control agent, and a magnetic powder. The external additive adheres to a surface of the toner mother particle. The toner particles do not need to contain any external additive if unnecessary. In a situation in which the toner particles do not contain any external additive, the toner mother particles are equivalent to the toner particles. The toner T may be a capsule toner or a non-capsule toner. The capsule toner T can be prepared by forming a shell layer on the surface of each toner mother particle.

The toner T has a number average roundness of at least 0.965 and no greater than 0.998. As a result of the number average roundness of the toner T being at least 0.965, development and transfer can be performed favorably, so that a truer image can be output. As a result of the number average roundness of the toner T being no greater than 0.998, the toner T is prevented from easily passing through the gap between the cleaning blade 81 and the circumferential surface of the photosensitive member 50. The toner T preferably has a number average roundness of at least 0.970 and no greater than 0.998, more preferably at least 0.980 and no greater than 0.998, and still more preferably at least 0.990 and no greater than 0.998. The number average roundness of the toner T can be measured according to a method described in association with Examples.

The toner T has a $D_{50}$ of at least 4.0 μm and no greater than 7.0 μm. As a result of $D_{50}$ of the toner T being no greater than 7.0 μm, non-grainy high-definition output image can be obtained. The amount of the toner T necessary to obtain a desired image density decreases with a decrease in $D_{50}$ of the toner T. It is therefore possible to reduce the amount of the toner T to be used as long as $D_{50}$ of the toner T is no greater than 7.0 μm. As a result of $D_{50}$ of the toner T being at least 4.0 μm, the toner T does not easily pass through the gap between the cleaning blade 81 and the circumferential surface of the photosensitive member 50. $D_{50}$ of the toner T is preferably at least 4.0 μm and no greater than 6.0 μm, and more preferably at least 4.0 μm and no greater than 5.0 μm. $D_{50}$ of the toner T can be measured according to a method described in association with Examples.

The image forming apparatus 1 according to the present embodiment can inhibit occurrence of a ghost image even if the toner T having such a small particle diameter and such a high roundness as described above is used, and the cleaning blade 81 is tightly pressed against the photosensitive member 50.

<Charging Roller>

Each charging roller 51 is located in contact with or adjacent to the circumferential surface of the corresponding photosensitive member 50. The image forming apparatus 1 adopts a direct discharge process or a proximity discharge process. The charging time is shorter and the charge amount is smaller in a configuration including the charging roller 51 located in contact with or adjacent to the circumferential surface of the photosensitive member 50 than in a configuration including a scorotron charger. In image formation using the image forming apparatus 1 including the charging roller 51 located in contact with or adjacent to the circumferential surface of the photosensitive member 50, therefore, it is difficult to uniformly charge the circumferential surface of the photosensitive member 50 and a ghost image can easily occur. However, as already described, the image forming apparatus 1 according to the present embodiment can inhibit occurrence of a ghost image. According to the present embodiment, therefore, it is possible to sufficiently inhibit occurrence of a ghost image even if the charging roller 51 is located in contact with or adjacent to the circumferential surface of the photosensitive member 50.

A distance between the charging roller 51 and the circumferential surface of the photosensitive member 50 is preferably no greater than 50 μm, and more preferably no greater than 30 μm. The image forming apparatus 1 according to the present embodiment can sufficiently inhibit occurrence of a ghost image even if the distance between the charging roller 51 and the circumferential surface of the photosensitive member 50 is in the above-specified range.

A charging bias (a charging voltage) is applied to the charging roller 51. The charging bias is a direct current voltage. The amount of electrical discharge from the charging roller 51 to the photosensitive member 50 can be smaller and the abrasion amount of the photosensitive layer 502 of the photosensitive member 50 can be smaller in a configuration in which the charging bias is a direct current voltage than in a configuration in which the charging voltage is a composite voltage of an alternating current voltage superimposed on a direct current voltage.

A ghost image tends to occur particularly when the charging roller 51 is located in contact with or adjacent to the circumferential surface of the photosensitive member 50 and the charging bias is a direct current voltage. However, as long as the photosensitive member 50 satisfies mathematical formulae (1), (2), and (3), the image forming apparatus 1 according to the present embodiment can inhibit occurrence of a ghost image even if the charging roller 51 is located in contact with or adjacent to the circumferential surface of the photosensitive member 50 and the charging bias is a direct current voltage.

The charging roller 51 preferably has a resistance of at least 5.0 log Ω and no greater than 7.0 log Ω and more preferably at least 5.0 log Ω and no greater than 6.0 log Ω As a result of the resistance of the charging roller 51 being at least 5.0 log Ω leakage current in the photosensitive layer 502 of the photosensitive member 50 tends not to occur. As a result of the resistance of the charging roller 51 being no greater than 7.0 log Ω elevation of the resistance of the charging roller 51 tends not to occur. The resistance of the charging roller 51 can be measured according to a method described in association with Examples.

<Static Elimination Lamp>

The static elimination lamps 54 are located downstream of the respective primary transfer rollers 53 in the rotation direction R of the photosensitive members 50. The cleaners 55 are located downstream of the respective static elimination lamps 54 in the rotation direction R of the photosensitive members 50. The charging rollers 51 are located downstream of the respective cleaners 55 in the rotation direction R of the photosensitive members 50. Since each static elimination lamp 54 is located between the corresponding primary transfer roller 53 and the corresponding cleaner 55, it is ensured that a time from static elimination of the circumferential surface of the corresponding photosensitive member 50 by the static elimination lamp 54 to charging of the circumferential surface of the photosensitive member 50 by the corresponding charging roller 51 (also referred to below as a static elimination-charging time) is sufficiently long. Thus, a time for eliminating excited carriers generated within the photosensitive layer 502 is ensured. The static elimination-charging time is preferably at least 20 milliseconds, and more preferably at least 50 milliseconds.

An intensity of the static elimination light upon arrival at the circumferential surface of the photosensitive member 50 after having been emitted from the static elimination lamp 54 (referred to below as a static elimination light intensity) is preferably at least 0 $\mu J/cm^2$ and no greater than 10 $\mu J/cm^2$, and more preferably at least 0 $\mu J/cm^2$ and no greater than 5 $\mu J/cm^2$. As a result of the static elimination light intensity of the static elimination lamps 54 being no greater than 10 $\mu J/cm^2$, the amount of charge trapped in the photosensitive layers 502 of the photosensitive members 50 is reduced, improving chargeability of the photosensitive members 50. Preferably, the static elimination light intensity of the static elimination lamps 54 is as low as possible. Note that the static elimination light intensity of the static elimination lamps 54 being 0 $\mu J/cm^2$ means a static elimination-less system, which is a system without static elimination of the photosensitive members 50 by the static elimination lamps 54. The static elimination light intensity of the static elimination lamps 54 can be measured according to a method described in association with Examples.

<Cleaner>

Each of the cleaners 55 includes the cleaning blade 81 and a toner seal 82. The cleaning blade 81 is located downstream of the corresponding primary transfer roller 53 in the rotation direction R of the corresponding photosensitive member 50. The cleaning blade 81 is pressed against the circumferential surface of the photosensitive member 50 and collects residual toner T on the circumferential surface of the photosensitive member 50. The residual toner T refers to the toner T remaining on the circumferential surface of the photosensitive member 50 after primary transfer. Specifically, a distal end of the cleaning blade 81 is pressed against the circumferential surface of the photosensitive member 50, and a direction from a proximal end to the distal end of the cleaning blade 81 is opposite to the rotation direction R at a point of contact between the distal end of the cleaning blade 81 and the circumferential surface of the photosensitive member 50. The cleaning blade 81 is in counter-contact with the circumferential surface of the photosensitive member 50. Thus, the cleaning blade 81 is tightly pressed against the circumferential surface of the photosensitive member 50 such that the cleaning blade 81 digs into the photosensitive member 50 as the photosensitive member 50 rotates. Insufficient cleaning can be further prevented through the cleaning blade 81 being tightly pressed against the circumferential surface of the photosensitive member 50. The cleaning blade 81 is for example a plate-shaped elastic member. More specifically, the cleaning blade 81 is plate-shaped rubber. The cleaning blade 81 is in line-contact with the circumferential surface of the photosensitive member 50.

The linear pressure of the cleaning blade 81 on the circumferential surface of the photosensitive member 50 is at least 10 N/m and no greater than 40 N/m. As a result of the linear pressure of the cleaning blade 81 on the circumferential surface of the photosensitive member 50 being at least 10 N/m, insufficient cleaning can be prevented. As a result of the linear pressure of the cleaning blade 81 on the circumferential surface of the photosensitive member 50 being no greater than 40 N/m, occurrence of a ghost image can be inhibited. In order to prevent insufficient cleaning while inhibiting occurrence of a ghost image, the linear pressure of the cleaning blade 81 on the circumferential surface of the photosensitive member 50 is preferably at least 30 N/m and no greater than 40 N/m, and more preferably at least 35 N/m and no greater than 40 N/m. Still more preferably, in order to inhibit occurrence of a ghost image while preventing insufficient cleaning particularly effectively, the toner T has a number average roundness of at least 0.980 and no greater than 0.998, the toner T has a $D_{50}$ of at least 4.0 μm and no greater than 6.0 μm, and the linear pressure of the cleaning blade 81 on the circumferential surface of the photosensitive member 50 is at least 30 N/m and no greater than 40 N/m (particularly preferably, at least 35 N/m and no greater than 40 N/m).

The cleaning blade 81 preferably has a hardness of at least 60 and no greater than 80, and more preferably at least 70 and no greater than 78. As a result of the hardness of the cleaning blade 81 being at least 60, the cleaning blade 81 is not too soft, favorably preventing insufficient cleaning. As a result of the hardness of the cleaning blade 81 being no greater than 80, the cleaning blade 81 is not too hard, reducing the abrasion amount of the photosensitive layer 502 of the photosensitive member 50. The hardness of the cleaning blade 81 can be measured according to a method described in association with Examples.

The cleaning blade 81 preferably has a rebound resilience of at least 20% and no greater than 40%, and more preferably at least 25% and no greater than 35%. The rebound resilience of the cleaning blade 81 can be measured according to a method described in association with Examples.

The toner seal 82 is located in contact with the circumferential surface of the photosensitive member 50 between the corresponding primary transfer roller 53 and the cleaning blade 81, and prevents the toner T collected by the cleaning blade 81 from scattering.

<Primary Transfer Roller>

Figure 6:
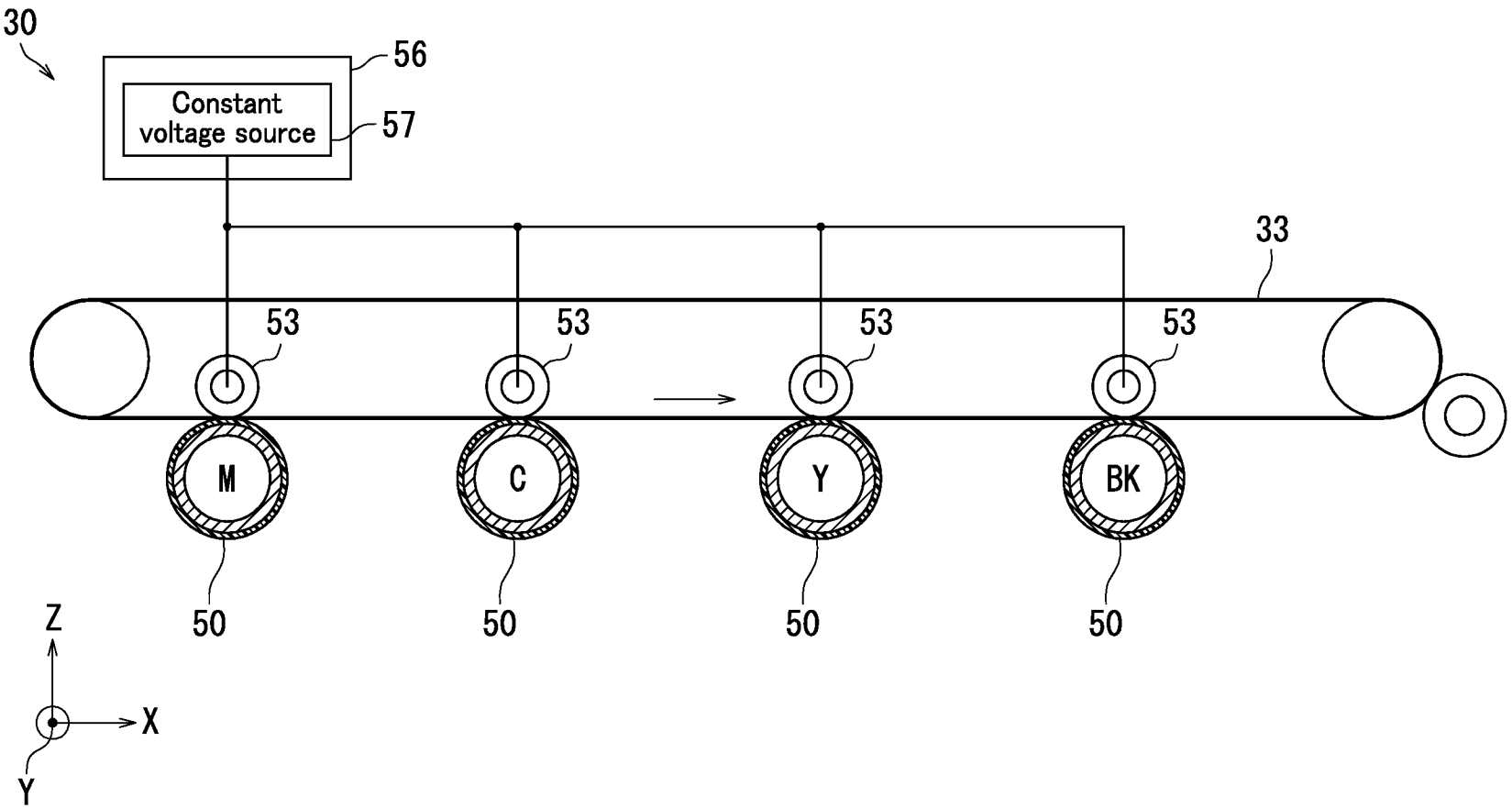
FIG. 6 is a diagram illustrating a power supply system for primary transfer rollers included in the image forming apparatus illustrated in FIG. 1.

The following describes the primary transfer rollers 53, which are under constant-voltage control, with reference to FIG. 6. FIG. 6 is a diagram illustrating a power supply system for the four primary transfer rollers 53. As illustrated in FIG. 6, the image forming section 30 further includes a power source 56 connected with the four primary transfer rollers 53. The power source 56 can charge each of the primary transfer rollers 53. The power source 56 includes a constant voltage source 57 connected with the four primary transfer rollers 53. The constant voltage source 57 applies a transfer bias (a transfer voltage) to the primary transfer rollers 53 to charge the primary transfer rollers 53 in primary transfer. The constant voltage source 57 generates a constant transfer bias (for example, a constant negative transfer bias). That is, the primary transfer rollers 53 are under constant-voltage control. A potential difference (transfer fields) between the surface potential of the circumferential surfaces of the photosensitive members 50 and the surface potential of the primary transfer rollers 53 causes primary transfer of the toner images carried on the circumferential surfaces of the respective photosensitive members 50 to the outer surface of the circulating transfer belt 33.

In primary transfer, a current (for example, a negative current) flows from the primary transfer rollers 53 into the respective photosensitive members 50 through the transfer belt 33. In a configuration in which the primary transfer rollers 53 are disposed right above the respective photosensitive members 50, the current flows from the primary transfer rollers 53 into the photosensitive members 50 in a thickness direction of the transfer belt 33. The value of the current flowing into the photosensitive members 50 (transfer current value) changes as the volume resistivity of the transfer belt 33 changes provided that a constant transfer bias is applied to the primary transfer rollers 53. The tendency of a ghost image to occur increases with an increase in the transfer current value. That is, a ghost image is more likely to occur in an image formed by the image forming apparatus 1 including the primary transfer rollers 53, which are under constant-voltage control, than in an image formed by an image forming apparatus that adopts constant-current control. However, the image forming apparatus 1 according to the present embodiment includes the photosensitive members 50 capable of inhibiting occurrence of a ghost image. It is therefore possible to inhibit occurrence of a ghost image even if an image is formed using the image forming apparatus 1 including the primary transfer rollers 53 under constant-voltage control. In the image forming apparatus 1 including the primary transfer rollers 53 under constant-voltage control, the number of constant voltage sources 57 can be smaller than the number of primary transfer rollers 53. Thus, the image forming apparatus 1 can be simplified and miniaturized.

<Thrust Mechanism>

Figure 7:
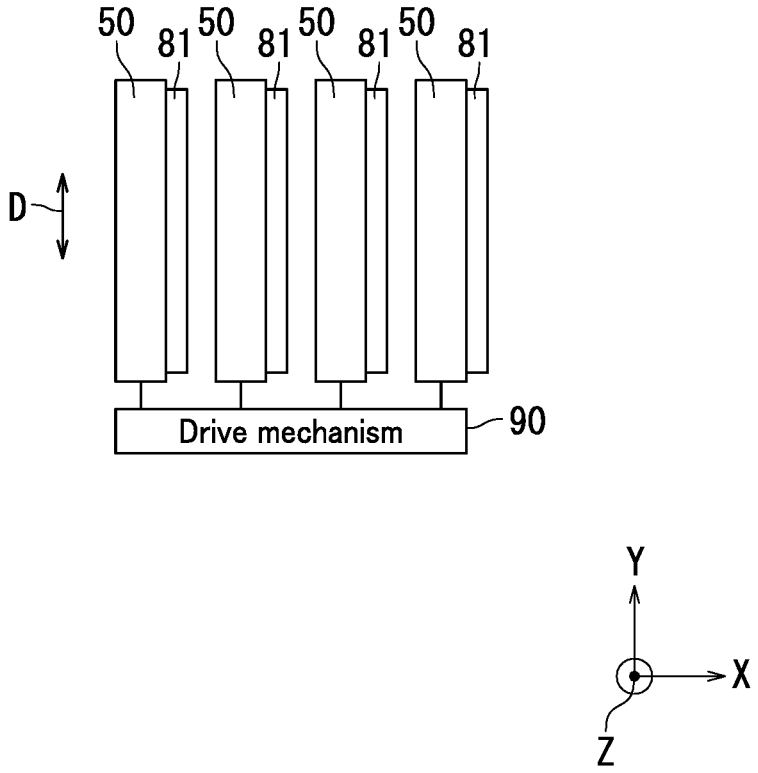
FIG. 7 is a diagram illustrating a drive mechanism for implementing a thrust mechanism.

The following describes a drive mechanism 90 for implementing a thrust mechanism with reference to FIG. 7. FIG. 7 is a plan view illustrating the photosensitive members 50, the cleaning blades 81, and the drive mechanism 90. Each of the photosensitive members 50 has a circular tubular shape elongated in a rotational axis direction D of the photosensitive member 50. Each of the cleaning blades 81 has a plate-like shape elongated in the rotational axis direction D.

The image forming apparatus 1 further includes the drive mechanism 90. The drive mechanism 90 causes either the photosensitive members 50 or the cleaning blades 81 to reciprocate in the rotational axis direction D. In the present embodiment, the drive mechanism 90 causes the photosensitive members 50 to reciprocate in the rotational axis direction D. The drive mechanism 90 for example includes a drive source such as a motor, a gear train, a plurality of cams, and a plurality of elastic members. The cleaning blades 81 are fixed to a housing of the image forming apparatus 1.

According to the present embodiment, as described with reference to FIG. 7, the photosensitive members 50 are caused to reciprocate in the rotational axis direction D against the cleaning blades 81. Accordingly, local accumulation on and around the edge of each cleaning blade 81 can be moved in the rotational axis direction D, preventing a scratch in a circumferential direction (referred to below as "a circumferential scratch") from occurring on the circumferential surface of the corresponding photosensitive member 50. As a result, a streak that may occur in output images due to the toner T stuck in such a circumferential scratch is prevented. Thus, good quality of output images can be maintained over a long period of time.

Furthermore, according to the present embodiment in which the photosensitive members 50 are caused to reciprocate, it is easy to obtain driving force required for the reciprocation and restrict occurrence of toner leakage over opposite ends of each of the cleaning blades 81, compared to a configuration in which the cleaning blades 81 are caused to reciprocate.

The thrust amount of each photosensitive member 50 refers to a distance by which the photosensitive member 50 travels in one way of one back-and-forth motion. Note that in the present embodiment, an outward thrust amount and a return thrust amount are the same. The thrust amount of the photosensitive member 50 is preferably at least 0.1 mm and no greater than 2.0 mm, and more preferably at least 0.5 mm and no greater than 1.0 mm. As a result of the thrust amount of the photosensitive members 50 being within the above-specified range, occurrence of a circumferential scratch on the photosensitive member 50 can be favorably prevented.

The thrust period of each photosensitive member 50 refers to a time taken by the photosensitive member 50 to make one back-and-forth motion. In the present specification, the thrust period of the photosensitive member 50 is indicated by the number of rotations of the photosensitive member 50 per back-and-forth motion of the photosensitive member 50. The rotation speed of the photosensitive member 50 is constant. Accordingly, a longer thrust period of the photosensitive member 50 (i.e., more rotations of the photosensitive member 50 per back-and-forth motion of the photosensitive member 50) means that the photosensitive member 50 reciprocates more slowly. A shorter thrust period of the photosensitive member 50 (i.e., fewer rotations of the photosensitive member 50 per back-and-forth motion of the photosensitive member 50) means that the photosensitive member 50 reciprocates faster.

The thrust period of the photosensitive member 50 is preferably at least 10 rotations and no greater than 200 rotations, and more preferably at least 50 rotations and no greater than 100 rotations. As a result of the thrust period of the photosensitive member 50 being at least 10 rotations, it is easy to clean the circumferential surface of the photosensitive member 50. Furthermore, as a result of the thrust period of the photosensitive member 50 being at least 10 rotations, the color image forming apparatus 1 tends not to undergo unintended coloristic shift. As a result of the thrust period of the photosensitive member 50 being no greater than 200 rotations, occurrence of a circumferential scratch on the photosensitive member 50 can be prevented.

Through the above, the image forming apparatus 1 according to the present embodiment has been described. Although a configuration has been described in which the charging rollers 51 are employed as chargers, the image forming apparatus 1 may have a configuration in which the chargers are charging brushes located in contact with or adjacent to the circumferential surfaces of the respective photosensitive members 50. Although the chargers adopting a direct discharge process or a proximity discharge process (specifically, the charging rollers 51) have been described, the present disclosure is also applicable to chargers adopting a discharge process other than the direct discharge process and the proximity discharge process. Although a configuration in which the charging bias is a direct current voltage has been described, the present disclosure is also applicable to a configuration in which the charging bias is an alternating current voltage or a composite voltage. The composite voltage refers to a voltage of an alternating current voltage superimposed on a direct current voltage. Although the development rollers 52 each using a two-component developer containing the carrier CA and the toner T have been described, the present disclosure is also applicable to development devices each using a one-component developer. Although the image forming apparatus 1 adopting an intermediate transfer process has been described, the present disclosure is also applicable to an image forming apparatus adopting a direct transfer process.

[Image Forming Method]

The following describes an image forming method that is implemented by the image forming apparatus 1 according to the present embodiment. This image forming method includes collecting the toner T remaining on the circumferential surface of the photosensitive member 50 through the cleaning blade 81 being pressed against the circumferential surface of the photosensitive member 50 while the photosensitive member 50 is rotating (a toner collection process). The toner T has a number average roundness of at least 0.965 and no greater than 0.998. The toner T has a $D_{50}$ of at least 4.0 μm and no greater than 7.0 μm. The linear pressure of the cleaning blade 81 on the circumferential surface of the photosensitive member 50 is at least 10 N/m and no greater than 40 N/m. The photosensitive member 50 includes the conductive substrate 501 and the single-layer photosensitive layer 502. The photosensitive layer 502 contains a charge generating material, a hole transport material, an electron transport material, and a binder resin. The ionization potential $Ip_{HTM}$ of the hole transport material and the ionization potential $Ip_{CGM}$ of the charge generating material satisfy mathematical formulae (1), (2), and (3) described above. The image forming method that is implemented by the image forming apparatus 1 according to the present embodiment can inhibit occurrence of a ghost image even if the cleaning blade 81 is tightly pressed against the photosensitive member 50.

EXAMPLES

The following provides more specific description of the present disclosure through use of Examples. Note that the present disclosure is not limited to the scope of Examples.

<Measurement Method>

The following first describes methods for measuring physical properties in tests of Reference Example, Examples, and Comparative Examples.

(Ionization Potential)

The ionization potential $Ip_{HTM}$ of a target hole transport material and the ionization potential $Ip_{CGM}$ of a target charge generating material were measured using an atmospheric ultraviolet photoelectron spectrometer ("AC-3", product of RIKEN KEIKI Co., Ltd.). The ionization potential was measured under the following conditions.

Light intensity: 10 nW

Step: 0.05 eV

Measurement time: 10 seconds

Anode voltage: 2,950 V
Dead time: 0.0055 seconds
($D_{50}$ of Toner)

$D_{50}$ of a target toner was measured using a particle diameter distribution analyzer ("COULTER COUNTER MULTISIZER 3", product of Beckman Coulter, Inc.).

(Number Average Roundness of Toner)

The number average roundness of a target toner was measured using a flow particle imaging analyzer ("FPIA (registered Japanese trademark) 3000", product of Sysmex Corporation).

(Resistance of Charging Roller)

The resistance of a target charging roller was measured under environmental conditions of a temperature of 23° C. and a relative humidity of 53%. The resistance of the charging roller was measured using a jig. The jig included a metal roller for holding the charging roller, a voltage applicator for applying a voltage to the charging roller, and an ammeter for measuring the current flowing through the charging roller. First, the charging roller was left to stand for 4 hours under environmental conditions of a temperature of 23° C. and a relative humidity of 53%. Thereafter, the charging roller was placed on the metal roller of the jig. A total load of 1 kgf was applied to the charging roller with a load of 500 gf to either end of the charging roller. While the load was applied, a charging voltage (charging bias) of +500 V was applied to the shaft of the charging roller using the voltage applicator of the jig. The current was measured using the ammeter three seconds after the application of the charging bias. The resistance (unit: log Ω) of the charging roller was calculated from the voltage value of the applied charging bias and the measured current.

(Static Elimination Light Intensity)

An optical power meter ("OPTICAL POWER METER 3664", product of HIOKI E.E. CORPORATION) was embedded in a circumferential surface of a target photosensitive member in a position opposite to a static elimination lamp. Static elimination light having a wavelength of 660 nm was irradiated onto the photosensitive member using the static elimination lamp, and the intensity of the static elimination light at the circumferential surface of the photosensitive member was measured using the optical power meter.

(Linear Pressure of Cleaning Blade)

The linear pressure of a target cleaning blade was measured using a load cell ("LMA-A SMALL-SIZED COMPRESSION LOAD CELL", product of Kyowa Electronic Instruments Co., Ltd.). Specifically, the load cell was replaced with a photosensitive member in an evaluation apparatus such that the load cell was disposed in a position of contact between the cleaning blade and the circumferential surface of the photosensitive member. The angle of contact between the cleaning blade and the load cell was set to 23 degrees. The cleaning blade was pressed against the load cell. The linear pressure of the cleaning blade was measured using the load cell ten seconds after the start of the pressing. The thus measured linear pressure was taken to be the linear pressure of the cleaning blade.

(Hardness of Cleaning Blade)

The hardness of the cleaning blade was measured using a rubber hardness tester ("ASKER RUBBER HARDNESS TESTER Type A", product of KOBUNSHI KEIKI CO., LTD) by a method in accordance with JIS K 6301. (Rebound Resilience of Cleaning Blade)

The rebound resilience of the cleaning blade was measured using a rebound resilience tester ("RT-90", product of KOBUNSHI KEIKI CO., LTD) by a method in accordance with JIS K 6255 (equivalent to ISO 4662).

<Evaluation Apparatus>

The following describes the evaluation apparatus used for the tests of Reference Example, Examples, and Comparative Examples. The evaluation apparatus was a modified version of a multifunction peripheral ("TASKALFA 356Ci", product of KYOCERA Document Solutions Inc.). A configuration and settings of the evaluation apparatus were as follows.

Photosensitive member: positively chargeable single-layer OPC drum
Diameter of photosensitive member: 30 mm
Thickness of photosensitive layer of photosensitive member: 30 μm
Linear velocity of photosensitive member: 250 mm/second
Thrust amount of photosensitive member: 0.8 mm
Thrust period of photosensitive member: 70 rotations/back-and-forth motion
Charger: charging roller
Charging bias: direct current voltage of positive polarity
Material of charging roller: epichlorohydrin rubber with an ion conductor dispersed therein
Diameter of charging roller: 12 mm
Thickness of rubber-containing layer of charging roller: 3 mm
Resistance of charging roller: 5.8 log Ω upon application of a charging voltage of +500 V
Distance between charging roller and circumferential surface of photosensitive member: 0 μm (contact)
Effective charge length: 226 mm
Transfer process: intermediate transfer process
Transfer bias: direct current voltage of negative polarity under constant-voltage control Material of transfer belt: polyimide
Transfer width: 232 mm
Static elimination light intensity: 5 $\mu J/cm^2$
Static elimination-charging time: 125 milliseconds
Cleaner: counter-contact cleaning blade
Contact angle of cleaning blade: 23 degrees
Material of cleaning blade: polyurethane rubber
Hardness of cleaning blade: 73
Rebound resilience of cleaning blade: 30%
Thickness of cleaning blade: 1.8 mm
Pressing method of cleaning blade: by fixing digging amount of cleaning blade in photosensitive member (fixed deflection)
Digging amount of cleaning blade in photosensitive member: value in range of from 0.8 mm to 1.5 mm (value varying depending on linear pressure of cleaning blade)

Reference Example: Severe Test

In order to determine values of the linear pressure of the cleaning blade to be studied for Examples and Comparative Examples, a severe test was carried out to figure out a relationship between $D_{50}$ of toner, the number average roundness of toner, and the linear pressure of the cleaning blade. Specifically, a photosensitive member according to Reference Example was mounted in the evaluation apparatus. A toner was loaded into a toner container of the evaluation apparatus, and a developer containing the toner and a carrier was loaded into a development device of the evaluation apparatus. An image I (a black longitudinal band-shaped image having a length of 100 mm parallel with the rotation direction of the photosensitive member) was printed on 100,000 successive sheets of paper using the evaluation apparatus under low-temperature and low-humidity environmental conditions (temperature: 10° C., relative humidity: 10%). The 100,000-sheet printing was a condition for the surface roughness of the cleaning blade and the surface roughness of the circumferential surface of the photosensitive member to increase. The low-temperature and low-humidity environmental conditions were for the hardness of the cleaning blade to increase and for the cleaning blade to easily decrease in performance. The evaluation apparatus was set so that the toner was not transferred during the printing of the image I. Specifically, the evaluation apparatus was set so that the transfer bias was not applied during the printing of the image I. Since the toner was not transferred, the whole amount of the toner developed on the photosensitive member was collected by the cleaning blade. After the 100,000-sheet printing, the circumferential surface of the photosensitive member was visually observed to confirm presence or absence of toner that had escaped capture by the cleaning blade on the circumferential surface of the photosensitive member. The above-described test was repeated by gradually increasing the linear pressure of the cleaning blade to determine the lowest linear pressure at which the cleaning blade was able to completely prevent the toner from escaping its capture (a minimum linear pressure for preventing insufficient cleaning).

Figure 8:
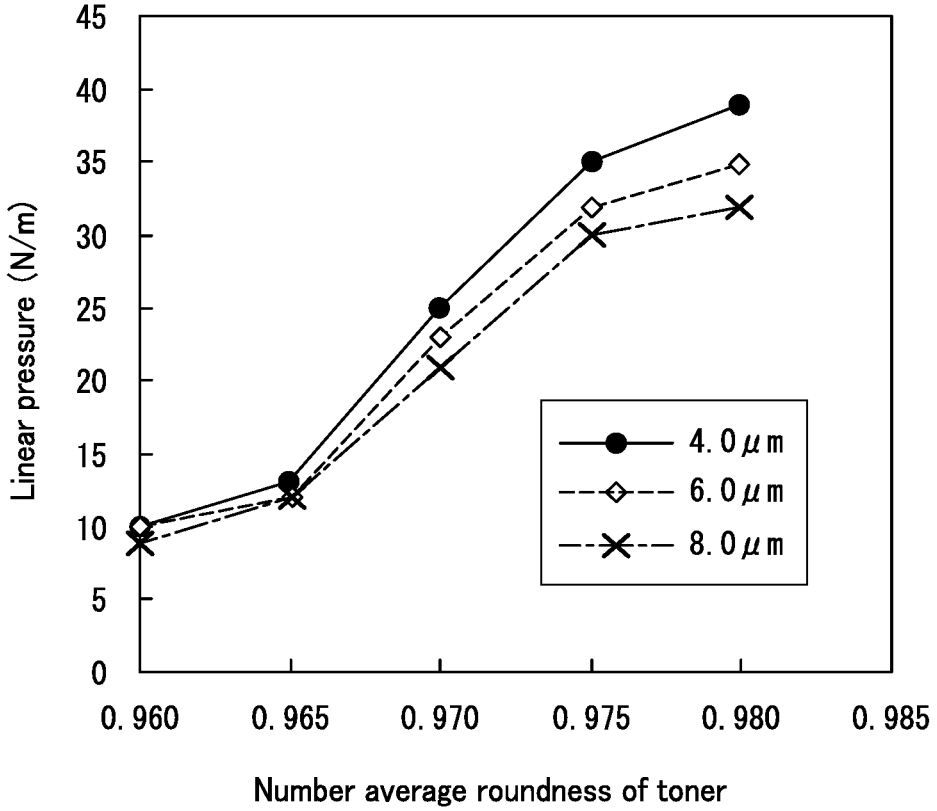
FIG. 8 is a graph representation illustrating a relationship between volume median diameter of toner, number average roundness of toner, and linear pressure of a cleaning blade.

The minimum linear pressure for preventing insufficient cleaning was measured with respect to each of 15 toners having a $D_{50}$ of 4.0 μm, 6.0 μm, or 8.0 μm and a number average roundness of 0.960, 0.965, 0.970, 0.975, or 0.980. FIG. 8 shows measurement results. In FIG. 8, the vertical axis represents minimum linear pressure for preventing insufficient cleaning (unit: N/m), and the horizontal axis represents number average roundness of toner. In FIG. 8, circles on the plot indicate measurement results of the toners having a $D_{50}$ of 4.0 μm, diamonds on the plot indicate measurement results of the toners having a $D_{50}$ of 6.0 μm, and crosses on the plot indicate measurement results of the toners having a $D_{50}$ of 8.0 μm.

FIG. 8 demonstrates that the smaller $D_{50}$ of toner is, the higher the minimum linear pressure for preventing insufficient cleaning is, which in other words the higher the linear pressure necessary for cleaning is. FIG. 8 also demonstrates that the higher the number average roundness of toner is, the higher the minimum linear pressure for preventing insufficient cleaning is, which in other words the higher the linear pressure necessary for cleaning is. FIG. 8 also indicates that a linear pressure of at least approximately 12 N/m and no greater than approximately 40 N/m is preferable for the use of the toners having a $D_{50}$ of no greater than 7.0 μm and a number average roundness of at least 0.965. Since the above-described severe test was carried out under severe conditions, a test using an image forming apparatus with respect to Examples and Comparative Examples for practical use was decided to be carried out to study a linear pressure of the cleaning blade of at least 10 N/m and no greater than 40 N/m.

<Production of Photosensitive Member>

Photosensitive members according to Examples and Comparative Examples to be mounted in an image forming apparatus were produced. Photosensitive layers of the photosensitive members were produced using materials and a method described below.

Charge generating materials, hole transport materials, electron transport materials, and a binder resin described below were prepared as materials of the photosensitive layers of the photosensitive members.

(Charge Generating Material)

The chloroindium phthalocyanine described in association with the embodiment was prepared as a charge generating material.

The Y-form titanyl phthalocyanine described in association with the embodiment was prepared as another charge generating material. This Y-form titanyl phthalocyanine did not exhibit a peak in a range of from 50° C. to 270° C. and exhibited a peak in a range of higher than 270° C. and no higher than 400° C. (specifically, a single peak at 296° C.) in a differential scanning calorimetry spectrum thereof, other than a peak resulting from vaporization of adsorbed water.

Metal-free phthalocyanine having an X-form crystal structure (referred to below as X-form metal-free phthalocyanine) was also prepared as a charge generating material for Comparative Examples.

(Hole Transport Material)

The hole transport materials (10-1) to (10-3) and (11-1) described in association with the embodiment were prepared as hole transport materials.

A compound represented by chemical formula (HTM-A) (referred to below as a hole transport material (HTM-A)) was also prepared as a hole transport material for Comparative Examples.

(HTM-A)

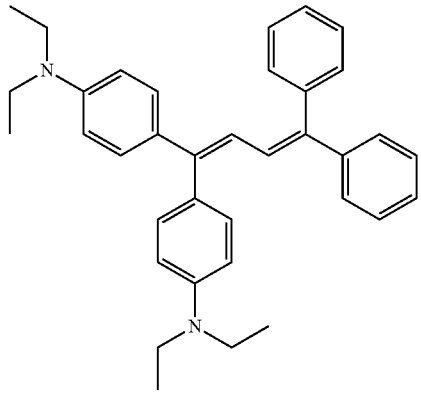

(Electron Transport Material)

The electron transport materials (1-1) and (2-1) described in association with the embodiment were prepared as electron transport materials.

(Binder Resin)

A polyarylate resin having a main chain represented by general formula (20-1*a*) and a terminal group represented by chemical formula (Z) described in association with the embodiment (also referred to below as a polyarylate resin (PA-1)) was prepared as the binder resin. The polyarylate resin (PA-1) had a viscosity average molecular weight of 60,000.

(Production of Photosensitive Member (A-1))

A vessel of a ball mill was charged with 1 part by mass of the chloroindium phthalocyanine as the charge generating material, 20 parts by mass of the hole transport material (11-1), 12 parts by mass of the electron transport material (1-1), 12 parts by mass of the electron transport material (2-1), 55 parts by mass of the polyarylate resin (PA-1) as the binder resin, and tetrahydrofuran as a solvent. The vessel contents were mixed for 50 hours using the ball mill to disperse the materials (the charge generating material, the hole transport material, the electron transport materials, and the binder resin) in the solvent. Through the above, an application liquid for photosensitive layer formation was obtained. The application liquid for photosensitive layer formation was applied onto a conductive substrate—an aluminum drum-shaped support—by dip coating to form a liquid film. The liquid film was hot-air dried at 100° C. for 40 minutes. Through the above, a single-layer photosensitive layer (film thickness: 30 μm) was formed on the conductive substrate. As a result, a photosensitive member (A-1) was obtained.

(Production of Photosensitive Members (A-2) to (A-7) and (B-1) to (B-8))

Each of photosensitive members (A-2) to (A-7) and (B-1) to (B-8) was produced according to the same method as in the production of the photosensitive member (A-1) in all aspects other than that the hole transport material and the charge generating material of type specified in Table 2 were used.

<Measurement of Photosensitive Member>

With respect to each of the photosensitive members (A-1) to (A-7) produced as described above, surface friction coefficient, Martens hardness of the photosensitive layer, and sensitivity were measured.

(Surface Friction Coefficient of Circumferential Surface of Photosensitive Member)

A non-woven fabric ("KIMWIPE S-200", product of NIPPON PAPER CRECIA CO., LTD.) was placed on the circumferential surface of the photosensitive member, and a weight (load: 200 gf) was placed on the non-woven fabric. An area of contact between the weight and the circumferential surface of the photosensitive member with the non-woven fabric therebetween was 1 $cm^2$. The photosensitive member was caused to laterally slide at a rate of 50 mm/second while the weight was fixed. Lateral friction force in the lateral sliding was measured using a load cell ("LMA-A SMALL-SIZED COMPRESSION LOAD CELL", product of Kyowa Electronic Instruments Co., Ltd.). The surface friction coefficient of the circumferential surface of the photosensitive member was calculated in accordance with the following expression: "Surface friction coefficient=measured lateral friction force/200". The circumferential surfaces of the photosensitive members (A-1) to (A-7) had surface friction coefficients of 0.52, 0.53, 0.58, 0.48, 0.55, 0.48, and 0.49, respectively.

(Martens Hardness of Photosensitive Layer)

The Martens hardness was measured using a hardness tester ("FISCHERSCOPE (registered Japanese trademark) HM2000XYp", product of Fischer Instruments K.K.) by a nanoindentation method in accordance with ISO 14577. The measurement was carried out as described below under environmental conditions of a temperature of 23° C. and a relative humidity of 50%. That is, a square pyramidal diamond indenter (opposite sides angled at 135 degrees) was brought into contact with the circumferential surface of the photosensitive layer, a load was gradually applied to the indenter at a rate of 10 mN/5 seconds, the load was retained for one second once the load reached 10 mN, and the load was removed five seconds after the retention. The thus measured Martens hardness of the photosensitive layer of the photosensitive member (A-1) was 220 $N/mm^2$.

(Sensitivity of Photosensitive Member)

With respect to each of the photosensitive members (A-1) to (A-7), sensitivity was evaluated. Sensitivity was evaluated under environmental conditions of a temperature of 23° C. and a relative humidity of 50%. First, the circumferential surface of the photosensitive member was charged to +500 V using a drum sensitivity test device (product of Gen-Tech, Inc.). Next, monochromatic light (wavelength: 780 nm, half-width: 20 nm, light intensity: 1.0 $\mu J/cm^2$) was obtained from white light of a halogen lamp using a bandpass filter. The thus obtained monochromatic light was irradiated onto the circumferential surface of the photosensitive member. A surface potential of the circumferential surface of the photosensitive member was measured when 50 milliseconds elapsed from termination of irradiation. The thus measured surface potential was taken to be a post-irradiation potential (unit: +V). The photosensitive members (A-1) to (A-7) resulted in post-irradiation potentials of +130 V, +120 V, +110 V, +105 V, +95 V, +90 V, and +100 V, respectively.

<Evaluation of Ghost Image and Cleanability>

With respect to each of the photosensitive members (A-1) to (A-7) and (B-1) to (B-8), the photosensitive member was mounted in the evaluation apparatus. The transfer current of a transfer device of the evaluation apparatus was set to −20 μA. A toner was loaded into a toner container of the evaluation apparatus, and a developer containing the toner and a carrier was loaded into a development device of the evaluation apparatus. An image II (a lateral band-shaped image having a coverage of 5%) was printed on 100,000 successive sheets of paper (A4 size) using the evaluation apparatus under low-temperature and low-humidity environmental conditions (temperature: 10° C., relative humidity: 10%). The lateral band-shaped image was a rectangular solid image having a lateral dimension of 200 mm and a longitudinal dimension of 15 mm. Immediately after the 100,000-sheet printing, an image III was printed on a sheet of paper using the evaluation apparatus. The image III included an image region IIIA on a leading edge side of the paper and an image region IIIB on a trailing edge side of the paper in terms of a paper conveyance direction. The image region IIIA included a circular solid image portion and a background blank paper portion. The image region IIIA corresponded to an image region formed through the first rotation of the photosensitive member in formation of the image III. The image region IIIB included a halftone image portion. The image region IIIB corresponded to an image region formed through the second rotation of the photosensitive member in formation of the image III. The halftone image portion of the printed image III was visually observed to confirm presence or absence of a ghost image (residual image) resulting from the circular solid image portion of the image III. After the printing of the image III, the circumferential surface of the photosensitive member was visually observed to confirm presence or absence of toner that had escaped capture by the cleaning blade on the circumferential surface of the photosensitive member. The above-described evaluation was performed using each of a toner T-1 (particle diameter: 4 μm, number average roundness: 0.998) and a toner T-2 (particle diameter: 7 μm, number average roundness: 0.965). The particle diameter of each of the toners T-1 and T-2 refers to $D_{50}$. Also, the above-described evaluation was performed by setting the linear pressure of the cleaning blade to each of 10 N/m, 20 N/m, 30 N/m, and 40 N/m. Next, the ghost image evaluation and the cleanability evaluation were performed according to the same method as described above in all aspects other than that the low-temperature and low-humidity environmental conditions (temperature: 10° C., relative humidity: 10%) were changed to standard-temperature and standard-humidity environmental conditions (temperature: 23° C., relative humidity: 50%).

Based on results of ghost image confirmation under the standard-temperature and standard-humidity environmental conditions, whether or not occurrence of a ghost image had been inhibited was evaluated in accordance with the following evaluation standard.

A: No ghost image was observed.

B: A ghost image was slightly observed, which was negligible in terms of practical use.

C: A ghost image was clearly observed.

Overall evaluation was determined to be good if the ghost image evaluation included no C. Overall evaluation was determined to be bad if the ghost image evaluation included at least one C. Table 2 shows results of the ghost image evaluation using the toner T-1. Table 3 shows results of the ghost image evaluation using the toner T-2.

Based on results of the confirmation of the presence or absence of escaped toner, whether or not insufficient cleaning had been prevented was evaluated in accordance with the following evaluation standard. Table 4 shows results of the cleanability evaluation using the toner T-1. Table 5 shows results of the cleanability evaluation using the toner T-2.

A: No escaped toner was observed under the standard-temperature and standard-humidity environmental conditions, and the low-temperature and low-humidity environmental conditions.

B: No escaped toner was observed under the standard-temperature and standard-humidity environmental conditions, but escaped toner was observed under the low-temperature and low-humidity environmental conditions.

C: Escaped toner was slightly observed under the standard-temperature and standard-humidity environmental conditions, and escaped toner was observed under the low-temperature and low-humidity environmental conditions.

D: Escaped toner was clearly observed under the standard-temperature and standard-humidity environmental conditions, and escaped toner was observed under the low-temperature and low-humidity environmental conditions.

In Tables 2 to 5, "HTM" means hole transport material. "$Ip_{HTM}$" means ionization potential of hole transport material. "CGM" means charge generating material. "$Ip_{CGM}$" means ionization potential of charge generating material. "$Ip_{HTM}$–$Ip_{CGM}$" means value obtained by subtracting ionization potential of charge generating material from ionization potential of hole transport material. "Roundness" means number average roundness. "InClPc" means chloroindium phthalocyanine. "Y—TiOPc" means Y-form titanyl phthalocyanine. "X—$H_2Pc$" means X-form metal-free phthalocyanine.

TABLE 2

| | | | | | | | Ghost image (Toner T-1: particle diameter 4.0 μm, roundness: 0.998) | | | | |
|---|---|---|---|---|---|---|---|---|---|---|---|
| | | HTM | | CGM | | | Linear pressure [N/m] | | | | |
| | Photosensitive member | Type | $Ip_{HTM}$ [eV] | Type | $Ip_{CGM}$ [eV] | $Ip_{HTM} - Ip_{CGM}$ [eV] | 10 | 20 | 30 | 40 | Overall evaluation |
| Example 1 | A-1 | 11-1 | 5.60 | InClPc | 5.41 | 0.19 | A | A | A | A | Good |
| Example 2 | A-2 | 11-1 | 5.60 | Y-TiOPc | 5.33 | 0.27 | A | A | A | B | Good |
| Example 3 | A-3 | 10-3 | 5.58 | InClPc | 5.41 | 0.17 | A | A | B | B | Good |
| Example 4 | A-4 | 10-3 | 5.58 | Y-TiOPc | 5.33 | 0.25 | A | A | B | B | Good |
| Example 5 | A-5 | 10-2 | 5.50 | InClPc | 5.41 | 0.09 | A | A | B | B | Good |
| Example 6 | A-6 | 10-2 | 5.50 | Y-TiOPc | 5.33 | 0.17 | A | B | B | B | Good |
| Example 7 | A-7 | 10-1 | 5.42 | Y-TiOPc | 5.33 | 0.09 | A | B | B | B | Good |
| Comparative Example 1 | B-1 | 10-1 | 5.42 | InClPc | 5.41 | 0.01 | A | B | B | C | Bad |
| Comparative Example 2 | B-2 | 10-2 | 5.50 | X-$H_2Pc$ | 5.23 | 0.27 | A | B | C | C | Bad |
| Comparative Example 3 | B-3 | 10-1 | 5.42 | X-$H_2Pc$ | 5.23 | 0.19 | B | B | C | C | Bad |
| Comparative Example 4 | B-4 | HTM-A | 4.97 | X-$H_2Pc$ | 5.23 | −0.26 | B | B | C | C | Bad |
| Comparative Example 5 | B-5 | 11-1 | 5.60 | X-$H_2Pc$ | 5.23 | 0.37 | B | C | C | C | Bad |
| Comparative Example 6 | B-6 | 10-3 | 5.58 | X-$H_2Pc$ | 5.23 | 0.35 | B | C | C | C | Bad |
| Comparative Example 7 | B-7 | HTM-A | 4.97 | InClPc | 5.41 | −0.44 | C | C | C | C | Bad |
| Comparative Example 8 | B-8 | HTM-A | 4.97 | Y-TiOPc | 5.33 | −0.36 | C | C | C | C | Bad |

TABLE 3

| | | | | | | | Ghost image (Toner T-2: particle diameter 7.0 μm, roundness: 0.965) | | | | |
|---|---|---|---|---|---|---|---|---|---|---|---|
| | | HTM | | CGM | | | Linear pressure [N/m] | | | | |
| | Photosensitive member | Type | $Ip_{HTM}$ [eV] | Type | $Ip_{CGM}$ [eV] | $Ip_{HTM} - Ip_{CGM}$ [eV] | 10 | 20 | 30 | 40 | Overall evaluation |
| Example 1 | A-1 | 11-1 | 5.60 | InClPc | 5.41 | 0.19 | A | A | A | A | Good |
| Example 2 | A-2 | 11-1 | 5.60 | Y-TiOPc | 5.33 | 0.27 | A | A | A | B | Good |
| Example 3 | A-3 | 10-3 | 5.58 | InClPc | 5.41 | 0.17 | A | A | B | B | Good |
| Example 4 | A-4 | 10-3 | 5.58 | Y-TiOPc | 5.33 | 0.25 | A | A | B | B | Good |

TABLE 3-continued

| | Photosensitive member | HTM Type | HTM $Ip_{HTM}$ [eV] | CGM Type | CGM $Ip_{CGM}$ [eV] | $Ip_{HTM} - Ip_{CGM}$ [eV] | Ghost image (Toner T-2: particle diameter 7.0 μm, roundness: 0.965) Linear pressure [N/m] 10 | 20 | 30 | 40 | Overall evaluation |
|---|---|---|---|---|---|---|---|---|---|---|---|
| Example 5 | A-5 | 10-2 | 5.50 | InClPc | 5.41 | 0.09 | A | A | B | B | Good |
| Example 6 | A-6 | 10-2 | 5.50 | Y-TiOPc | 5.33 | 0.17 | A | B | B | B | Good |
| Example 7 | A-7 | 10-1 | 5.42 | Y-TiOPc | 5.33 | 0.09 | A | B | B | B | Good |
| Comparative Example 1 | B-1 | 10-1 | 5.42 | InClPc | 5.41 | 0.01 | A | B | B | C | Bad |
| Comparative Example 2 | B-2 | 10-2 | 5.50 | X-$H_2$Pc | 5.23 | 0.27 | A | B | C | C | Bad |
| Comparative Example 3 | B-3 | 10-1 | 5.42 | X-$H_2$Pc | 5.23 | 0.19 | B | B | C | C | Bad |
| Comparative Example 4 | B-4 | HTM-A | 4.97 | X-$H_2$Pc | 5.23 | −0.26 | B | B | C | C | Bad |
| Comparative Example 5 | B-5 | 11-1 | 5.60 | X-$H_2$Pc | 5.23 | 0.37 | B | C | C | C | Bad |
| Comparative Example 6 | B-6 | 10-3 | 5.58 | X-$H_2$Pc | 5.23 | 0.35 | B | C | C | C | Bad |
| Comparative Example 7 | B-7 | HTM-A | 4.97 | InClPc | 5.41 | −0.44 | C | C | C | C | Bad |
| Comparative Example 8 | B-8 | HTM-A | 4.97 | Y-TiOPc | 5.33 | −0.36 | C | C | C | C | Bad |

TABLE 4

| | Photosensitive member | HTM Type | HTM $Ip_{HTM}$ [eV] | CGM Type | CGM $Ip_{CGM}$ [eV] | $Ip_{HTM} - Ip_{CGM}$ [eV] | Cleanability (Toner T-1: particle diameter 4.0 μm, roundness: 0.998) Linear pressure [N/m] 10 | 20 | 30 | 40 |
|---|---|---|---|---|---|---|---|---|---|---|
| Example 1 | A-1 | 11-1 | 5.60 | InClPc | 5.41 | 0.19 | C | C | B | A |
| Example 2 | A-2 | 11-1 | 5.60 | Y-TiOPc | 5.33 | 0.27 | C | C | B | A |
| Example 3 | A-3 | 10-3 | 5.58 | InClPc | 5.41 | 0.17 | C | C | B | A |
| Example 4 | A-4 | 10-3 | 5.58 | Y-TiOPc | 5.33 | 0.25 | C | C | B | A |
| Example 5 | A-5 | 10-2 | 5.50 | InClPc | 5.41 | 0.09 | C | C | B | A |
| Example 6 | A-6 | 10-2 | 5.50 | Y-TiOPc | 5.33 | 0.17 | C | C | B | A |
| Example 7 | A-7 | 10-1 | 5.42 | Y-TiOPc | 5.33 | 0.09 | C | C | B | A |
| Comparative Example 1 | B-1 | 10-1 | 5.42 | InClPc | 5.41 | 0.01 | C | C | B | A |
| Comparative Example 2 | B-2 | 10-2 | 5.50 | X-$H_2$Pc | 5.23 | 0.27 | C | C | B | A |
| Comparative Example 3 | B-3 | 10-1 | 5.42 | X-$H_2$Pc | 5.23 | 0.19 | C | C | B | A |
| Comparative Example 4 | B-4 | HTM-A | 4.97 | X-$H_2$Pc | 5.23 | −0.26 | C | C | B | A |
| Comparative Example 5 | B-5 | 11-1 | 5.60 | X-$H_2$Pc | 5.23 | 0.37 | C | C | B | A |
| Comparative Example 6 | B-6 | 10-3 | 5.58 | X-$H_2$Pc | 5.23 | 0.35 | C | C | B | A |
| Comparative Example 7 | B-7 | HTM-A | 4.97 | InClPc | 5.41 | −0.44 | C | C | B | A |
| Comparative Example 8 | B-8 | HTM-A | 4.97 | Y-TiOPc | 5.33 | −0.36 | C | C | B | A |

TABLE 5

| | Photosensitive member | HTM Type | HTM $Ip_{HTM}$ [eV] | CGM Type | CGM $Ip_{CGM}$ [eV] | $Ip_{HTM} - Ip_{CGM}$ [eV] | Cleanability (Toner T-2: particle diameter 7.0 μm, roundness: 0.965) Linear pressure [N/m] 10 | 20 | 30 | 40 |
|---|---|---|---|---|---|---|---|---|---|---|
| Example 1 | A-1 | 11-1 | 5.60 | InClPc | 5.41 | 0.19 | A | A | A | A |
| Example 2 | A-2 | 11-1 | 5.60 | Y-TiOPc | 5.33 | 0.27 | A | A | A | A |
| Example 3 | A-3 | 10-3 | 5.58 | InClPc | 5.41 | 0.17 | A | A | A | A |
| Example 4 | A-4 | 10-3 | 5.58 | Y-TiOPc | 5.33 | 0.25 | A | A | A | A |
| Example 5 | A-5 | 10-2 | 5.50 | InClPc | 5.41 | 0.09 | A | A | A | A |
| Example 6 | A-6 | 10-2 | 5.50 | Y-TiOPc | 5.33 | 0.17 | A | A | A | A |
| Example 7 | A-7 | 10-1 | 5.42 | Y-TiOPc | 5.33 | 0.09 | A | A | A | A |
| Comparative Example 1 | B-1 | 10-1 | 5.42 | InClPc | 5.41 | 0.01 | A | A | A | A |
| Comparative Example 2 | B-2 | 10-2 | 5.50 | X-$H_2$Pc | 5.23 | 0.27 | A | A | A | A |
| Comparative Example 3 | B-3 | 10-1 | 5.42 | X-$H_2$Pc | 5.23 | 0.19 | A | A | A | A |
| Comparative Example 4 | B-4 | HTM-A | 4.97 | X-$H_2$Pc | 5.23 | −0.26 | A | A | A | A |
| Comparative Example 5 | B-5 | 11-1 | 5.60 | X-$H_2$Pc | 5.23 | 0.37 | A | A | A | A |
| Comparative Example 6 | B-6 | 10-3 | 5.58 | X-$H_2$Pc | 5.23 | 0.35 | A | A | A | A |
| Comparative Example 7 | B-7 | HTM-A | 4.97 | InClPc | 5.41 | −0.44 | A | A | A | A |
| Comparative Example 8 | B-8 | HTM-A | 4.97 | Y-TiOPc | 5.33 | −0.36 | A | A | A | A |

The toners used in the image forming apparatus including any of the photosensitive members (A-1) to (A-7) had a number average roundness of at least 0.965 and no greater than 0.998, and a $D_{50}$ of at least 4.0 μm and no greater than 7.0 μm. The linear pressure of the cleaning blade on the circumferential surface of each of the photosensitive members (A-1) to (A-7) was at least 10 N/m and no greater than 40 N/m. Each of the photosensitive members (A-1) to (A-7) included a conductive substrate and a single-layer photosensitive layer. The photosensitive layer contained a charge generating material, a hole transport material, an electron transport material, and a binder resin. The ionization potential $Ip_{HTM}$ of the hole transport material and the ionization potential $Ip_{CGM}$ of the charge generating material satisfied all of mathematical formula (1) "$Ip_{HTM} \geq 5.30$ eV", mathematical formula (2) "$Ip_{CGM} \geq 5.30$ eV", and mathematical formula (3) "$0.09 \text{ eV} \leq |Ip_{HTM} - Ip_{CGM}| \leq 0.30$ eV". Accordingly, as apparent from Tables 2 and 3, overall evaluation in the ghost image evaluation of the image forming apparatus including any of the photosensitive members (A-1) to (A-7) was good.

By contrast, the photosensitive member (B-1) failed to satisfy mathematical formula (3). The photosensitive members (B-2) and (B-3) failed to satisfy mathematical formula (2). The photosensitive member (B-4) failed to satisfy mathematical formulae (1) and (2). The photosensitive members (B-5) and (B-6) failed to satisfy mathematical formulae (2) and (3). The photosensitive members (B-7) and (B-8) failed to satisfy mathematical formulae (1) and (3). Accordingly, as apparent from Tables 2 and 3, overall evaluation in the ghost image evaluation of the image forming apparatus including any of the photosensitive members (B-1) to (B-8) was bad.

As shown in Tables 4 and 5, cleanability of the image forming apparatus including any of the photosensitive members (A-1) to (A-7) was not evaluated as D but was evaluated as A, B, or C. The evaluation results show that the image forming apparatus including any of the photosensitive members (A-1) to (A-7) is capable of inhibiting occurrence of a ghost image while ensuring cleanability to a practical degree.

As shown in Table 4, cleanability of the image forming apparatus including any of the photosensitive members (A-1) to (A-7) was evaluated as A or B when the linear pressure of the cleaning blade on the circumferential surface of the photosensitive member was at least 30 N/m and no greater than 40 N/m. The image forming apparatus including any of the photosensitive members (A-1) to (A-7) was able to inhibit occurrence of a ghost image while preventing insufficient cleaning more effectively when the linear pressure of the cleaning blade on the circumferential surface of the photosensitive member was at least 30 N/m and no greater than 40 N/m.

As shown in Table 4, cleanability of the image forming apparatus including any of the photosensitive members (A-1) to (A-7) was evaluated as A when the toner used therein had a number average roundness of at least 0.980 and no greater than 0.998, and a $D_{50}$ of at least 4.0 μm and no greater than 6.0 μm, and the linear pressure of the cleaning blade on the circumferential surface of the photosensitive member was at least 35 N/m and no greater than 40 N/m. The image forming apparatus including any of the photosensitive members (A-1) to (A-7) was able to inhibit occurrence of a ghost image while preventing insufficient cleaning particularly effectively when the toner used therein had a number average roundness of at least 0.980 and no greater than 0.998, and a $D_{50}$ of at least 4.0 μm and no greater than 6.0 μm, and the linear pressure of the cleaning blade on the circumferential surface of the photosensitive member was at least 35 N/m and no greater than 40 N/m.

What is claimed is:

1. An image forming apparatus comprising:

an image bearing member;

a charger configured to charge a circumferential surface of the image bearing member;

a static elimination device configured to eliminate static electricity from the circumferential surface of the image bearing member; and a cleaning member pressed against the circumferential surface of the image bearing member and configured to collect a toner remaining on the circumferential surface of the image bearing member, wherein the toner has a number average roundness of at least 0.965 and no greater than 0.998, the toner has a volume median diameter of at least 4.0 μm and no greater than 7.0 μm, a linear pressure of the cleaning member on the circumferential surface of the image bearing member is at least 10 N/m and no greater than 40 N/m, the static elimination device emits a static elimination light having an intensity of greater than 0 $\mu J/cm^2$ and no greater than 5 $\mu J/cm^2$ upon arrival at the circumferential surface of the image bearing member, the charger charges the circumferential surface of the image bearing member after at least 50 milliseconds from static elimination of the circumferential surface of the image bearing member by the static elimination device, the image bearing member includes a conductive substrate and a single-layer photosensitive layer, the single-layer photosensitive layer contains a charge generating material, a hole transport material, an electron transport material, and a binder resin, and ionization potential $Ip_{HTM}$ of the hole transport material and ionization potential $Ip_{CGM}$ of the charge generating material satisfy mathematical formulae (1), (2), and (3)

$$Ip_{HTM} \geq 5.30 \text{ eV} \quad (1)$$

$$Ip_{CGM} \geq 5.30 \text{ eV} \quad (2)$$

$$0.09 \text{ eV} \leq |Ip_{HTM} - Ip_{CGM}| \leq 0.30 \text{ eV}. \quad (3).$$

2. The image forming apparatus according to claim 1, wherein the linear pressure of the cleaning member on the circumferential surface of the image bearing member is at least 30 N/m and no greater than 40 N/m.

3. The image forming apparatus according to claim 1, wherein the hole transport material includes a compound represented by general formula (10) or (11), (10)

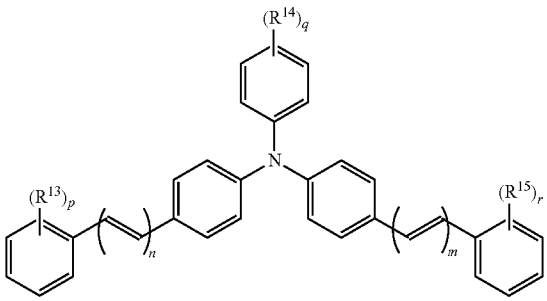

where in general formula (10), $R^{13}$ to $R^{15}$ each represent, independently of one another, an alkyl group having a carbon number of at least 1 and no greater than 4 or an alkoxy group having a carbon number of at least 1 and no greater than 4, m and n each represent, independently of one another, an integer of at least 1 and no greater than 3, p and r each represent, independently of one another, 0 or 1, and q represents an integer of at least 0 and no greater than 2, and (11)

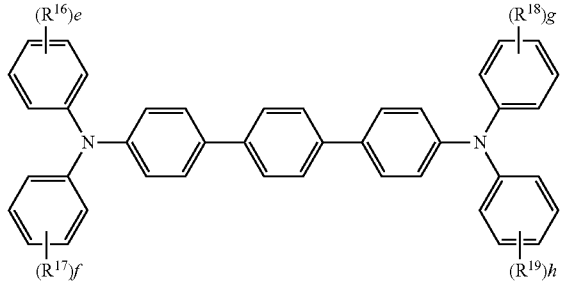

in general formula (11), $R^{16}$ to $R^{19}$ each represent, independently of one another, an alkyl group having a carbon number of at least 1 and no greater than 6, and e, f, g, and h each represent, independently of one another, an integer of at least 0 and no greater than 5.

4. The image forming apparatus according to claim 1, wherein the charge generating material includes titanyl phthalocyanine having a Y-form crystal structure or chloroindium phthalocyanine.

5. The image forming apparatus according to claim 1, wherein the charge generating material includes titanyl phthalocyanine having a Y-form crystal structure, and the hole transport material includes a compound represented by chemical formula (10-1), (10-2), (10-3), or (11-1)

(10-1)

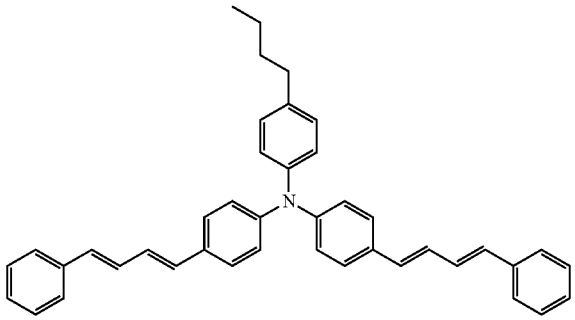

-continued (10-2)

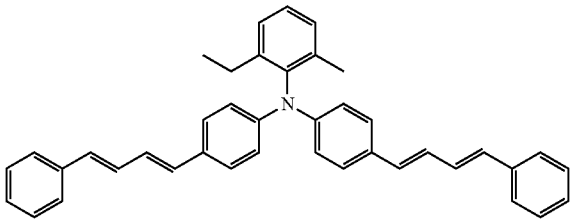

(10-3)

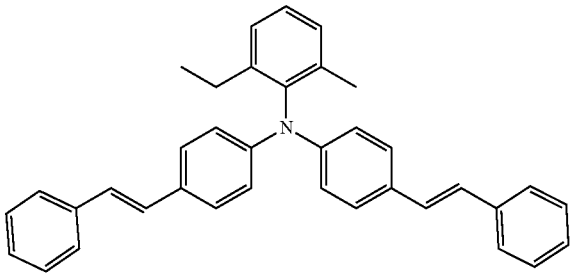

(11-1)

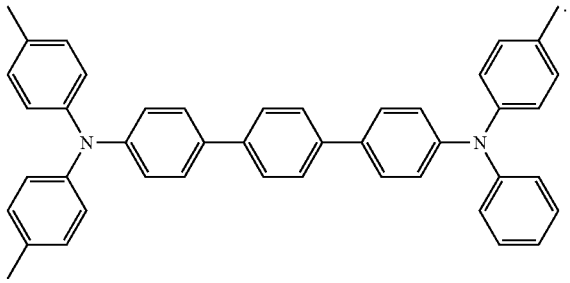

6. The image forming apparatus according to claim 1, wherein the charge generating material includes chloroindium phthalocyanine, and the hole transport material includes a compound represented by chemical formula (10-2), (10-3), or (11-1)

(10-2)

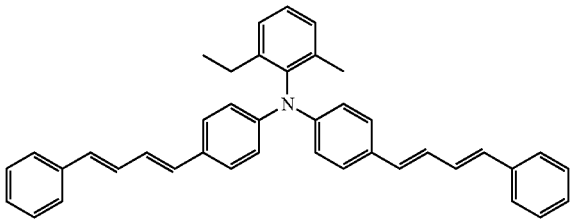

-continued (10-3)

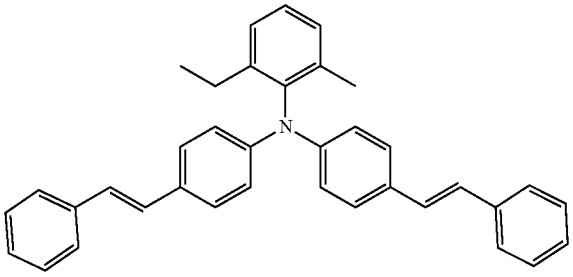

(11-1)

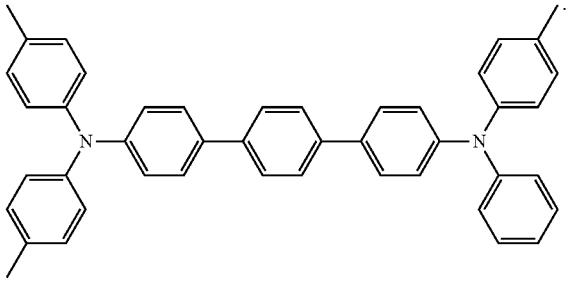

7. The image forming apparatus according to claim 1, wherein the binder resin includes a polyarylate resin including a repeating unit represented by general formula (20), (20)

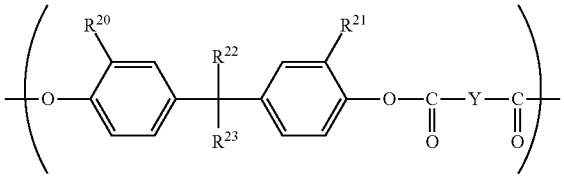

where in general formula (20), $R^{20}$ and $R^{21}$ each represent, independently of one another, a hydrogen atom or an alkyl group having a carbon number of at least 1 and no greater than 4, $R^{22}$ and $R^{23}$ each represent, independently of one another, a hydrogen atom, a phenyl group, or an alkyl group having a carbon number of at least 1 and no greater than 4, $R^{22}$ and $R^{23}$ may be bonded to one another to form a divalent group represented by general formula (W), and Y represents a divalent group represented by chemical formula (Y1), (Y2), (Y3), (Y4), (Y5), or (Y6), and (W)

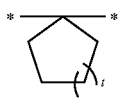

in general formula (W), t represents an integer of at least 1 and no greater than 3, and asterisks each represent a bond
(Y1)
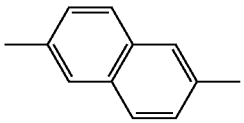
(Y2)
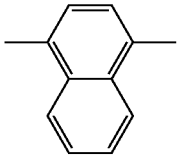
(Y3)
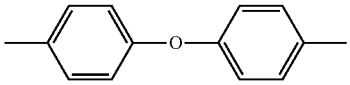
-continued
(Y4)
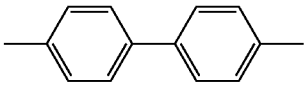
(Y5)
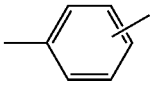
(Y6)
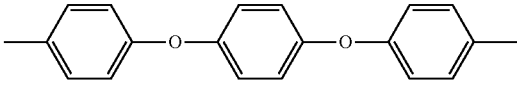
8. The image forming apparatus according to claim 1, wherein
the binder resin includes a polyarylate resin having a main chain represented by general formula (20-1) and a terminal group represented by chemical formula (Z),
(20-1)
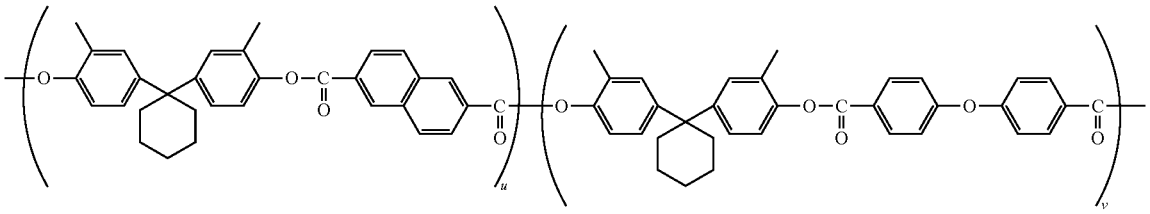
(Z)
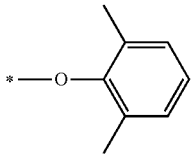

where in general formula (20-1), a sum of u and v is 100, and u is a number greater than or equal to 30 and less than or equal to 70, and in chemical formula (Z), an asterisk represents a bond.

9. The image forming apparatus according to claim 1, wherein the electron transport material includes at least one of compounds represented by general formulae (1) and (2), (1)

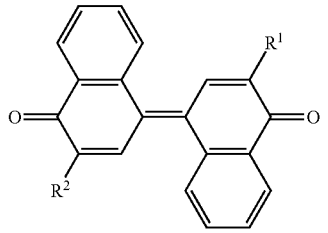

(2)

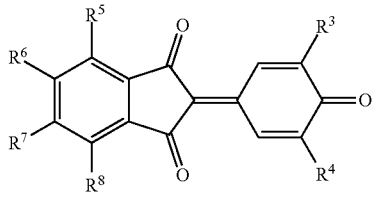

where in general formulae (1) and (2), $R^1$ to $R^4$ each represent, independently of one another, an alkyl group having a carbon number of at least 1 and no greater than 8, and $R^5$ to $R^8$ each represent, independently of one another, a hydrogen atom, a halogen atom, or an alkyl group having a carbon number of at least 1 and no greater than 4.

10. The image forming apparatus according to claim 1, wherein the electron transport material includes at least one of compounds represented by chemical formulae (1-1) and (2-1)

(1-1)

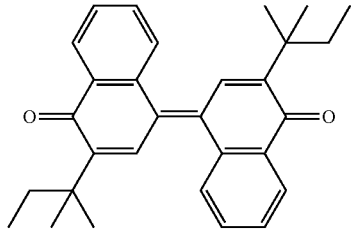

(2-1)

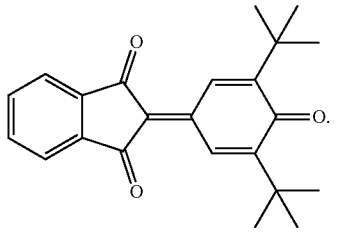

11. The image forming apparatus according to claim 1, wherein the charger is located in contact with or adjacent to the circumferential surface of the image bearing member.

12. The image forming apparatus according to claim 11, wherein a distance between the charger and the circumferential surface of the image bearing member is no greater than 50 μm.

13. The image forming apparatus according to claim 1, wherein the charge generating material includes chloroindium phthalocyanine.

14. The image forming apparatus according to claim 1, wherein the charge generating material includes chloroindium phthalocyanine, and the hole transport material includes a compound represented by chemical formula (11-1)

(11-1)

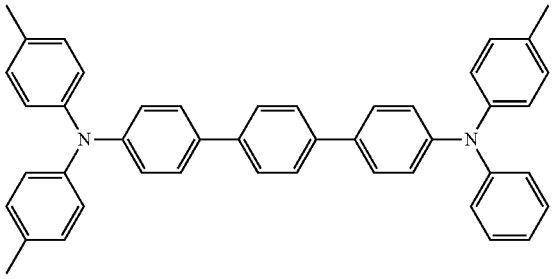

15. A method for forming an image, comprising:

charging a circumferential surface of an image bearing member by a charger;

eliminating static electricity from the circumferential surface of the image bearing member by a static elimination device; and collecting a toner remaining on the circumferential surface of the image bearing member through a cleaning member being pressed against the circumferential surface of the image bearing member while the image bearing member is rotating, wherein the toner has a number average roundness of at least 0.965 and no greater than 0.998, the toner has a volume median diameter of at least 4.0 μm and no greater than 7.0 μm, a linear pressure of the cleaning member on the circumferential surface of the image bearing member is at least 10 N/m and no greater than 40 N/m, the static elimination device emits a static elimination light having an intensity of greater than 0 $\mu J/cm^2$ and no greater than 5 $\mu J/cm^2$ upon arrival at the circumferential surface of the image bearing member, the charger charges the circumferential surface of the image bearing member after at least 50 milliseconds from static elimination of the circumferential surface of the image bearing member by the static elimination device, the image bearing member includes a conductive substrate and a single-layer photosensitive layer, the single-layer photosensitive layer contains a charge generating material, a hole transport material, an electron transport material, and a binder resin, ionization potential $Ip_{HTM}$ of the hole transport material and ionization potential $Ip_{CGM}$ of the charge generating material satisfy mathematical formulae (1), (2), and (3)

$$Ip_{HTM} \geq 5.30 \text{ eV} \quad (1)$$

$$Ip_{CGM} \geq 5.30 \text{ eV} \quad (2)$$

$$0.09 \text{ eV} \leq |Ip_{HTM} - Ip_{CGM}| \leq 0.30 \text{ eV} \quad (3)$$

16. The method for forming an image according to claim 15, wherein the charge generating material includes chloroindium phthalocyanine.

17. The method for forming an image according to claim 15, wherein the charge generating material includes chloroindium phthalocyanine, and the hole transport material includes a compound represented by chemical formula (11-1)

(11-1)

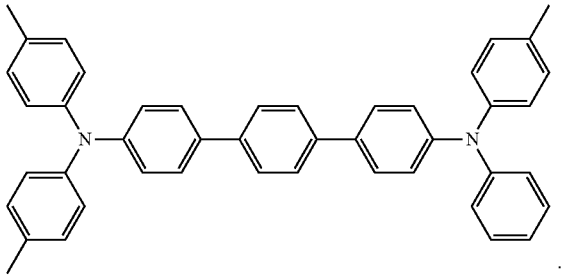

* * * * *